United States Patent [19]

Vanmaele et al.

[11] Patent Number: 4,871,654

[45] Date of Patent: Oct. 3, 1989

[54] PHOTOGRAPHIC ELEMENT INCORPORATING REDOX COMPOUNDS FOR USE IN A DYE DIFFUSION TRANSFER PROCESS

[75] Inventors: Luc J. Vanmaele, Lochristi; Christian C. Van de Sande, Belsele, both of Belgium

[73] Assignee: Agfa-Gevaert, N.V., Mortsel, Belgium

[21] Appl. No.: 180,082

[22] Filed: Apr. 11, 1988

[30] Foreign Application Priority Data

May 29, 1987 [EP] European Pat. Off. ..... 87201007.9

[51] Int. Cl.[4] ..... G03C 5/54; G03C 7/26

[52] U.S. Cl. ..... 430/512; 430/223; 430/542; 430/559; 430/562; 430/563; 430/955

[58] Field of Search ..... 430/223, 563, 559, 562, 430/542, 512, 955

[56] References Cited

U.S. PATENT DOCUMENTS 4,594,316 6/1986 Morimoto et al. ..... 430/223

4,663,273 5/1987 Van de Sande et al. ..... 430/223

*Primary Examiner*—Richard L. Schilling

*Attorney, Agent, or Firm*—A. W. Breiner

[57] ABSTRACT

Photographic silver halide emulsion element for dye image production comprising a support carrying at least one alkali-permeable silver halide hydrophilic colloid emulsion layer incorporating in operative association therewith a dye-releasing compound capable of releasing a diffusible dye moiety from a carrier moiety by a redox reaction, said compound corresponding to the general formula:

wherein CAR is an organic carrier moiety capable of undergoing a redox reaction, L is a group cleavable or releasable from the carrier moiety by a redox reaction taking place in alkaline condiitons as a function of the development of a silver halide emulsion layer incorporating such compound, G is a bridging group, each of $L^1$ and $L^2$ is a linking member, $PUG^1$ is a dye (precursor) group, $PUG^2$ is a dye (precursor) group, an UV-absorber group, or a singlet oxygen scavenger group.

10 Claims, No Drawings

PHOTOGRAPHIC ELEMENT INCORPORATING REDOX COMPOUNDS FOR USE IN A DYE DIFFUSION TRANSFER PROCESS

DESCRIPTION

The present invention relates to compounds for use in a dye diffusion transfer process and to photographic elements incorporating them.

Important non-conventional multicolour reproduction systems are based on dye diffusion transfer processing. These systems are of particular value for reasons of simplicity of processing and access speed to colour images.

Dye diffusion transfer imaging can be carried out in a number of ways but all dye diffusion transfer imaging systems are based on the same principle of modifying the solubility of the dyes as a function of the amount of photographic silver halide developed.

In commonly known dye diffusion transfer processes the dye-image-producing compounds are either initially mobile in alkaline aqueous media and become image-wise immobilized during processing, or initially immobile and become image-wise mobilized during processing.

A survey of such processes is given by Christian C. Van de Sande in Angew.Chem.Int.Ed.Engl. 22 (1983) 191–209.

Known dye-releasing compounds for use in a dye diffusion transfer process include e.g. triphenylmethane, xanthene, azo, azomethine, anthraquinone, alizarine, merocyanine, quinoline or cyanine dye structures. Of particularly frequent use is a dye-releasing compound having a mono-azo dye group (ref. e.g. U.S. Pat. No. 3,725,062).

Redox-controlled dye-releasing compounds have been introduced in commercial systems and are known from various sources.

Oxidizable dye-releasing compounds that after oxidation release a dye moiety by hydrolysis are known from e.g. German Pat. No. 2,242,762, German Pat. No. 2,406,664, German Pat. No. 2,505,246, German Pat. No. 2,613,005, German Pat. No. 2,645,656 and Research Disclosure publications Nos. 15,157 (Nov. 1976), 16,654 (Apr. 1977), and 17,736 (Jan. 1979).

In these references dye-releasing compounds have been described, in which the dye moiety is linked most frequently to an oxidizable carrier moiety through a sulphonamido group. The dye released from such compounds thus contains a sulphamoyl group.

Oxidizable dye-releasing compounds that in oxidized form release a dye moiety by intramolecular displacement reaction have been described in e.g. U.S. Pat. No. 3,443,940. The dye released from these compounds contains a sulphinate group.

It is particularly interesting in dye diffusion transfer to operate with dye-releasing compounds, the release of dye therefrom being inversely proportional to the development of a negative-working silver halide emulsion layer so that positive dye images can be formed in an image-receiving layer.

Dye-releasing compounds that in oxidized form are stable but in reduced state set free a dye moiety by an elimination reaction have been described in German Pat. No. 2,823,159 and German Pat. No. 2,854,946. Compounds of this type can be incorporated in reduced form in an unexposed silver halide emulsion material and can be called IHO-compounds, IHO being an acronym for "Inhibited Hydrolysis by Oxidation". When incorporated in the oxidized form these compounds are called IHR-compounds, IHR being an acronym for "Increased Hydrolysis by Reduction".

Reducible quinonoid IHR-compounds, which after reduction can undergo a dye release with an intermolecular nucleophilic displacement reaction have been described in German Pat. No. 2,809,716 wherein these compounds are called BEND-compounds, BEND standing for "Ballasted Electron-accepting Nucleophilic Displacement".

Reducible IHR-compounds, which after reduction can undergo a dye release with an elimination reaction have been described in published European Pat. No. 0,004,399 and in U.S. Pat. No. 4,371,604.

Other classes of compounds that may release a dye after reduction have been described in German Pat. No. 3,008,588 and German Pat. No. 3,014,669.

Particularly useful dye-releasing compounds are the redox-controlled dye-releasing compounds, which can be represented by:

BALL-REDOX-DYE wherein:

BALL represents a moiety with ballast residue for immobilizing the dye-releasing compound in a hydrophilic colloid layer, REDOX represents a redox-active group, i.e. a group that in circumstances of alkaline silver halide development is oxidizable or reducible and depending on the oxidized or reduced state brings about a dye release by an elimination reaction, nucleophilic displacement reaction, hydrolysis or cleavage reaction, DYE represents a diffusible dye moiety or a precursor thereof.

Redox-controlled p-sulfonamidophenol dye-releasing compounds, the releasable dye moiety of which comprises a triazine nucleus that constitutes a functional part of that dye moiety, have been described in U.S. Pat. No. 3,928,312.

It is a requirement that the dyes forming the photographic colour image have a desired light absorption, a sufficient density, and a good stability to light, heat, and moisture.

Several attempts have been made to increase the final absorption of coloured light by dye images in that dye-releasing compounds were provided, which are capable of releasing more than one dye part. It is known from e.g. U.S. Pat. No. 3,725,062 and Research Disclosure no. 24025 (Apr. 1984) p. 158–163 to use dye-releasing compounds that comprise more than one dye-providing part on a same carrier molecule part. Dye-releasing compounds containing several dye units linked to each other by chemical bonds or linking groups have been disclosed in U.S. Pat. No. 4,663,273.

However, in practical use difficulties can be encountered with respect to the synthesis of such dye-releasing compounds or with the light absorption, density, and/or stability of the dyes released thereby.

It is an object of the present invention to provide novel easily accessible dye-releasing compounds for use in photographic dye diffusion transfer processes, which compounds comprise more than one photographically useful group giving a dye image having a satisfactory light absorption, a sufficient density, and an adequate stability to light, heat, and moisture.

It is more particularly an object of the present invention to provide new coloured compounds that by a redox reaction and in alkaline conditions release dyes having good diffusibility for practical use in a photographic dye diffusion transfer imaging process and after completion of the diffusion have an appropriate absorption maximum and an appropriate absorption spectrum, such dyes also having a satisfactory dark-fading stability and stability to heat, light, and moisture.

It is another object of the present invention to provide a photographic silver halide element incorporating such compounds in non-diffusing state for image-wise release of a diffusible dye in a dye diffusion transfer imaging process.

Compounds according to the present invention can be used in lower molar amounts than prior art compounds used for the same purpose in dye diffusion transfer photography.

The higher yield of colour density obtained with the compounds of the present invention comprising several photographically useful groups allows economies on silver halide coverage, which is important with respect to the cost of silver. As an alternative, identical colour densities as those obtained with the prior art dye-releasing compounds can be obtained with the present dye-releasing compounds at lower coverage, thus leading to thinner layers, which allow a quicker coating and processing. Moreover, other photographic characteristics can be improved in consequence of other additionally released photographically useful groups e.g. groups that improve the dark-fading stability and/or the stability to light, heat, and moisture.

In accordance with the present invention a photographic silver halide emulsion element for dye image production is provided, which comprises a support carrying at least one alkali-permeable silver halide hydrophilic colloid emulsion layer incorporating in operative association therewith a dye-releasing compound capable of releasing a diffusible dye moiety from a carrier moiety by a redox reaction, characterized in that said dye-releasing compound corresponds to the following general formula I:

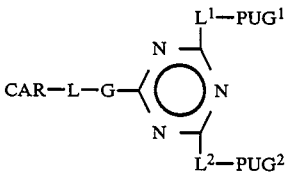

(I)

wherein:

CAR represents an organic carrier moiety capable of undergoing a redox reaction, which moiety may contain a ballasting group rendering said compound non-diffusing in a hydrophilic colloid medium in wet alkaline conditions, e.g. a quinonoid moiety, examples of which are given hereinafter, L represents a chemical group cleavable or releasable from the carrier moiety by a redox reaction taking place in alkaline conditions in dependence on and as a function of the development of a silver halide emulsion layer incorporating such compounds, G represents a bridging group e.g.

$$-(Ar^1-SO_2NR^1)_n-Ar^2-X-,$$

wherein $R^1$ represents hydrogen or an alkyl group e.g. a methyl group, each of $Ar^1$ and $Ar^2$ (same or different) represents a bivalent aromatic nucleus e.g. phenylene or such nucleus carrying one or more substituents e.g. substituents selected from the group consisting of alkyl e.g. methyl, alkoxy e.g. methoxy, alkylthio, halogen e.g. chlorine and bromine, sulpho, carboxy, alkylamino, and dialkylamino e.g. dimethylamino, X is a polyvalent atom e.g. —O— and —S— or a polyvalent atom group e.g. $—NR^2—$, $R^2$ being hydrogen or an alkyl group e.g. a methyl group, and n is a positive integer e.g. 1, and each of $L^1$ and $L^2$ (the same or different) represents a linking member, which can be a chemical bond, a polyvalent atom e.g. —O— and —S—, or a polyvalent atom group, e.g. —NH—, $—SO_2—$, and $—SO_2NH—$, a hydrocarbon group such as alkylene or arylene, these linking groups preferably including diffusion-promoting substituents, e.g. a phenylene group carrying a $—SO_2NH—$ group and a —NH— group, $PUG^1$ represents a photographically useful group selected from the group consisting of a dye group and a dye precursor group, and $PUG^2$ represents a photographically useful group selected from the group consisting of a dye group, a dye precursor group, an UV-absorber group, and a singlet oxygen scavenger group, and wherein, when $PUG^2$ is a dye group or a dye precursor group, it may have the same or a different composition as $PUG^1$.

Each of $PUG^1$ and $PUG^2$ may incorporate one or more groups that improve the diffusibility of the released triazine dye moiety in a hydrophilic colloid medium when permeated by an aqueous alkaline liquid, e.g. one or more members selected from the group consisting of hydroxy, ether, thioether, carbonamido, sulphonamido, carbamoyl, sulphamoyl, onium, amino, sulphonyl, ureido, cyano, carboxylic acid, sulphinic acid, sulphonic acid, phosphonic acid and salts and ester groups derived from these acid groups.

By the expression "triazine dye moiety" as used herein is meant a chemical moiety comprising a s-triazine nucleus carrying two photographically useful groups, at least one of which is a dye group, said chemical moiety being releasable or being released from a carrier moiety as a function of a redox-reaction or argentolytic reaction.

It has been established indeed that a s-triazine nucleus making part of compounds for use in photographic dye diffusion transfer processes offers the advantage that two photographically useful groups can be carried thereby without entailing adverse effects on the photographic characteristics and the stability of the released dye(s).

Compounds corresponding to the above general formula I contain the photographically useful groups $PUG^1$ and $PUG^2$, both attached via the linking members $L^1$ and $L^2$ respectively to a same s-triazine nucleus, in one of the following functional combinations, wherein:

(1) $PUG^1$ is a dye group or a dye precursor group, $PUG^2$ being an identical dye group or dye precursor group, or (2) $PUG^1$ is a dye group or a dye precursor group, $PUG^2$ being a different dye group or dye precursor group, or (3) $PUG^1$ is a dye group or a dye precursor group, $PUG^2$ being an UV absorber group, or (4) $PUG^1$ is a dye group or a dye precursor group, $PUG^2$ being a singlet oxygen scavenger group.

In the compounds according to the present invention $PUG^1$ is a dye group or a dye precursor group, which dye has any desired absorption range and any desired absorption maximum. For instance it can be a cyan dye group, a magenta dye group, a yellow dye group, or a black dye group.

In the case $PUG^2$ is identical to $PUG^1$, the purpose is to obtain a higher yield of colour density.

When $PUG^2$ is a dye group that differs from the dye group $PUG^1$, $PUG^2$ can be a dye group having an absorption range that is complementary to that of $PUG^1$ so that a desired composite absorption range is obtained.

The dye groups or their precursors can belong to or be derived from any dye class. Azo dye units either or not complexed with metal atoms are preferred. Dye precursors are either derivatives that by alkaline hydrolysis set free the actual dye, or compounds that generate the dye by complex formation with a metal ion.

When $PUG^2$ is an UV absorber group, the purpose is to protect the dye group $PUG^1$ from fading under the influence of ultraviolet radiation.

In the case $PUG^2$ is a singlet oxygen scavenger group the purpose of this group is to scavenge chemically active singlet oxygen, in the presence of which light can turn into a force that bleaches the dye group $PUG^1$. The scavenger group transforms singlet oxygen into the far less active triplet oxygen form. Thanks to the presence of the scavenger group the image dye retains its original hue for a considerably longer time than in the absence of the scavenger.

Preferred compounds for use in accordance with the present invention are those corresponding to the following general formula II:

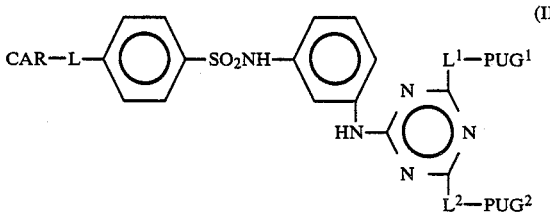

(II)

wherein the symbols CAR, L, $L^1$, $L^2$, $PUG^1$, and $PUG^2$ have the significance described above in general formula I, L preferably being $—SO_2$, and each of $L^1$ and $L^2$ preferably standing for a bivalent group corresponding to the structural formula:

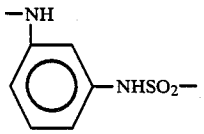

Examples of carrier moieties including the group —L—, i.e. (CAR—L—), from which in oxidized form a dye moiety is split off, are given hereinafter.

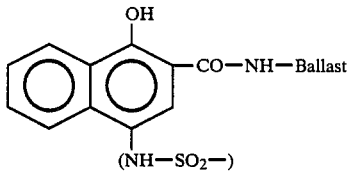

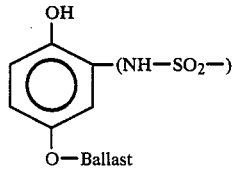

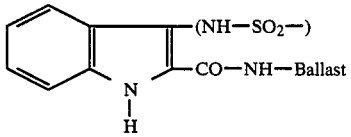

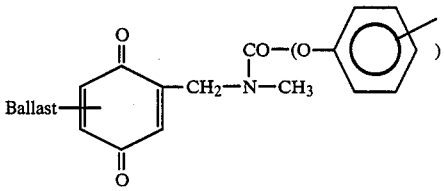

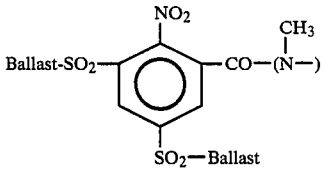

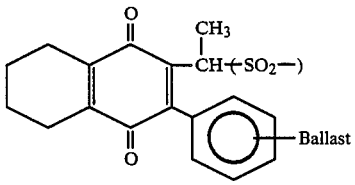

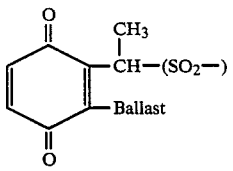

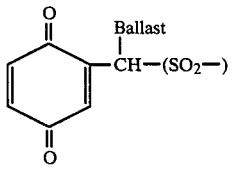

-continued

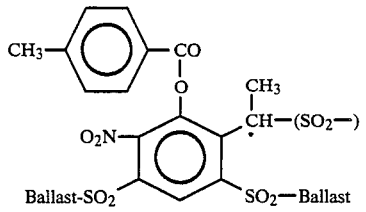

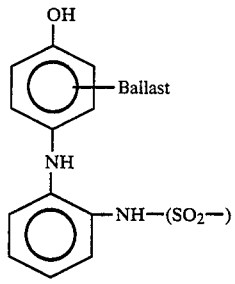

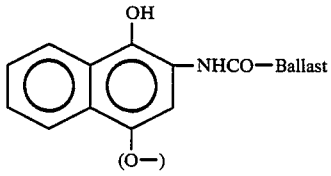

The groups within brackets are released together with the dye moiety (not represented), and remain as diffusion-promoting groups with the dye moiety.

In the above-mentioned dye-releasing compounds the dye release proceeds directly proportional to the rate of formation of the oxidation products of developing agent used in the development of silver halide. Said compounds are therefore negative-working in that they undergo dye release in correspondence with the exposed portions of a negative-working silver halide emulsion layer. For the production of positive pictures an image reversal is needed, which may be based on the use of positive-working layers containing a direct-positive silver halide emulsion or on the silver salt diffusion transfer reversal process by selecting a proper layer assemblage as described in e.g. European Pat. No. 0,003,376.

Examples of reducible carrier moieties (CAR—L—), from which a dye moiety can be set free after reduction are the following:

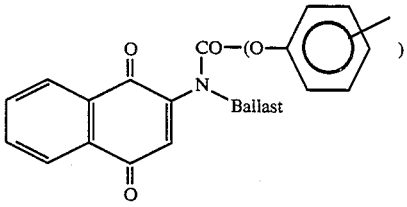

-continued

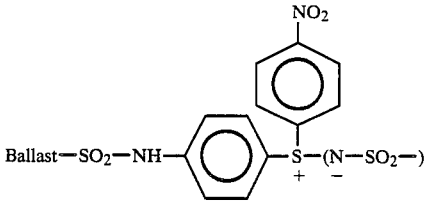

The groups within brackets are functional groups that are split off together with the dye moiety (not shown). These functional groups can be separated from the chromophoric group of the dye by a bridging group having no influence on the absorption properties of the dye. The functional group, however, optionally together with said bridging group, may be of importance to determine the diffusion-mobility and/or capability of the released dye to be mordanted. Useful bridging groups are e.g. alkylene and arylene groups.

Ballast groups that confer diffusion-resistance are groups that allow the compounds according to the invention to be incorporated in non-diffusing form in the hydrophilic colloids normally used in photographic elements. Organic groups usually carrying straight-chain or branched-chain aliphatic groups and also isocyclic or heterocyclic or aromatic groups mostly having from 8 to 20 carbon atoms are preferred for this purpose. These groups are attached to the molecule either directly or indirectly e.g. through one of the following groups: —NHCO—; —$NHSO_2$—; —NR—, in which R represents hydrogen or alkyl; —O—; —S—; or —$SO_2$—. The group conferring diffusion-resistance may in addition carry groups that confer solubility in water, e.g. sulpho groups or carboxy groups, and these may also be present in anionic form. Since the diffusion properties depend on the molecular size of the compound as a whole, it is sufficient in some cases e.g., when the molecule has a considerable size, to use one or more short-chain groups as groups conferring resistance to diffusion or to use no such group at all.

According to a preferred embodiment for positive dye image production with negative-working silver halide emulsions the above-mentioned triazine dye moiety forms part of the already mentioned dye-releasing quinonoid IHR-compounds, from which this moiety can be released in diffusible form by reduction and hydrolysis.

The reaction operative in the release of the triazine dye moiety from said quinonoid IHR-compounds proceeds in two stages illustrated by the following equations:

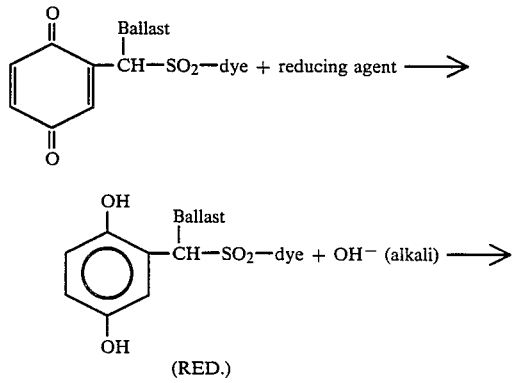

-continued

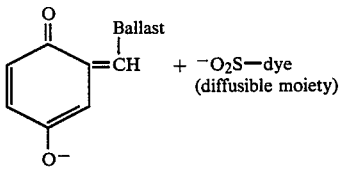

wherein: "Ballast" stands for a ballasting group rendering the compound non-diffusing in a hydrophilic colloid medium in wet alkaline conditions and the term "dye" used therein stands for the triazine dye moiety.

The term "diffusible" as used herein stands for "having the property of diffusing effectively through colloid layers of the photographic elements in alkaline liquid medium". The term "mobile" has the same meaning. The terms "non-diffusing" and "immobile" have the opposite meaning.

Particularly suitable quinonoid carrier groups (CAR—) correspond to the structural formulae listed in the following Table 1.

TABLE 1

| | |
|---|---|
| CAR 1 | 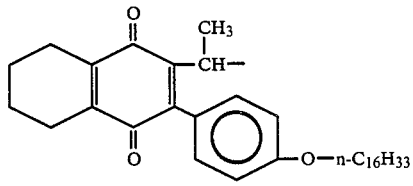 |
| CAR 2 | 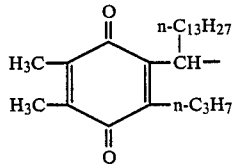 |

These carrier groups and other particularly useful carrier groups have been described in European Pat. Nos. 0,004,399; 0,038,092; 0,109,701; and in U.S. Pat. No. 4,273,855.

Particularly suitable groups that can be used as photographically useful (PUG) groups according to the present invention correspond to the following structural formulae listed in Table 2.

TABLE 2

| No. | Structural formula | Type of PUG |
|---|---|---|
| CD1 | 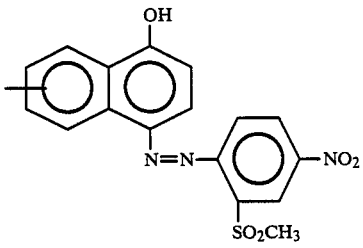 | cyan dye group |
| CD2 | 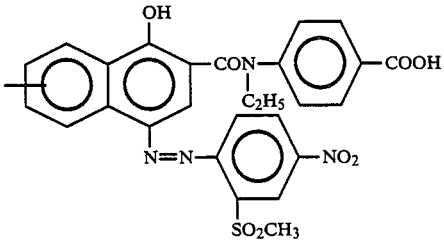 | cyan dye group |
| CD3 | 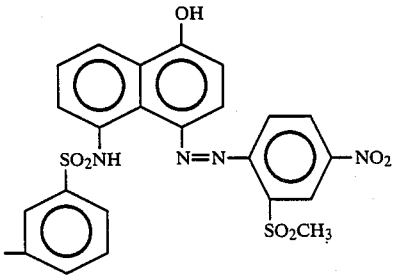 | cyan dye group |

TABLE 2-continued
| No. | Structural formula | Type of PUG |
|---|---|---|
| YD1 | 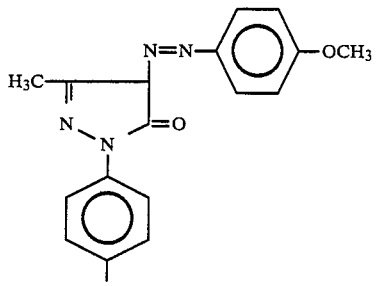 | yellow dye group |
| YD2 | 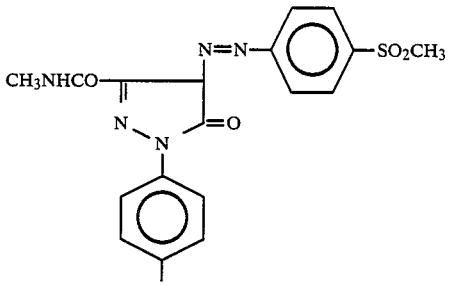 | yellow dye group |
| YD3 | 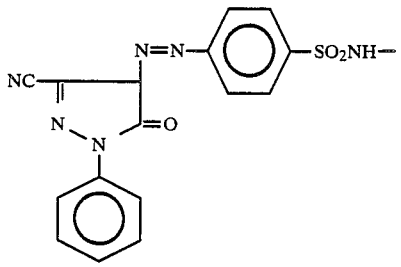 | yellow dye group |
| MD1 | 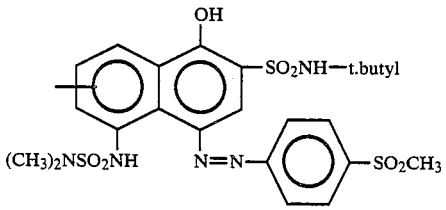 | magenta dye group |
| MD2 | 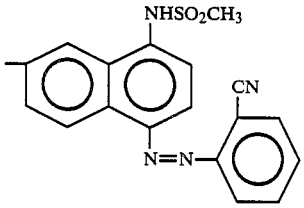 | magenta dye group |
| MD3 | 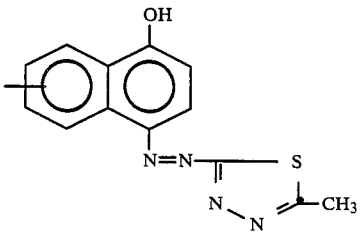 | magenta dye group |

TABLE 2-continued

| No. | Structural formula | Type of PUG |
|---|---|---|
| UV1 | 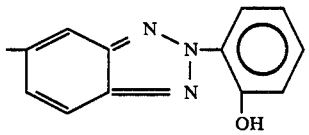 | UV-absorber group |
| UV2 | 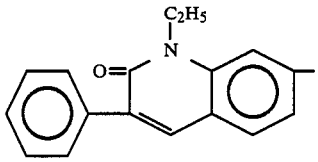 | UV-absorber group |
| SOS1 | 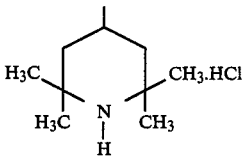 | singlet oxygen scavenger group |
| SOS2 | 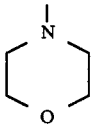 | singlet oxygen scavenger group |

Other suitable photographically useful groups (PUG) viz. dye groups have been disclosed in European Pat. No. 0,121,930.

For the synthesis of compounds containing dye groups as PUG reference can be made to e.g. U.S. Pat. Nos. 3,929,760, 3,954,476, 4,225,708, 4,256,831, and European Pat. No. 0004399.

Examples of cyan bis-azo dye IHR-compounds comprising two identical cyan dye groups as PUG, which can be used advantageously according to the present invention, are listed in the following Table 3.

TABLE 3

IHR-compound C 01

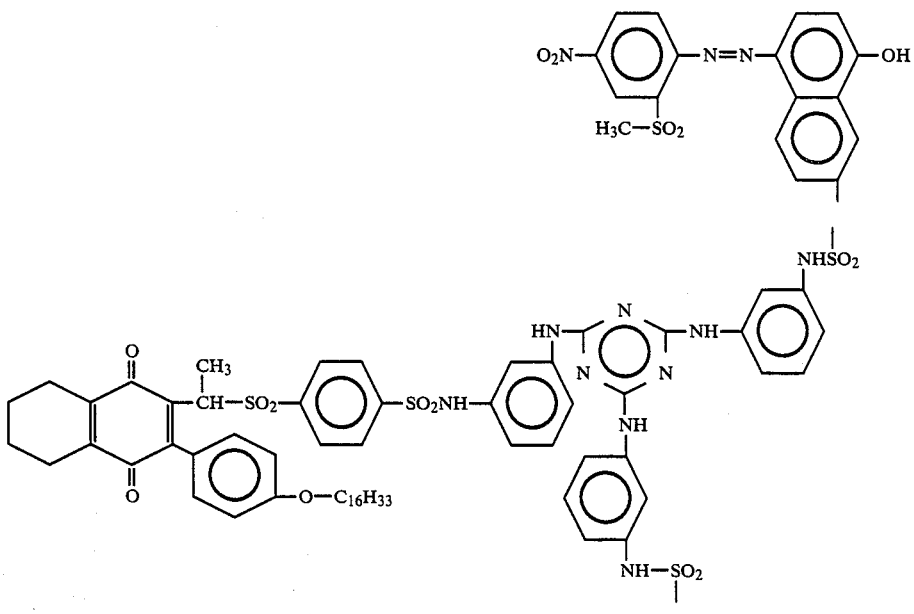

TABLE 3-continued
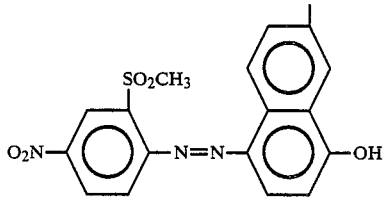
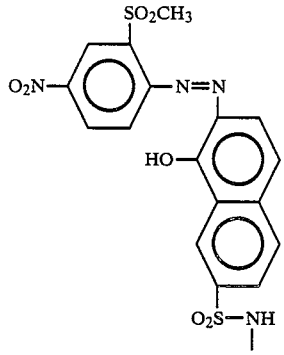
IHR-compound C 02
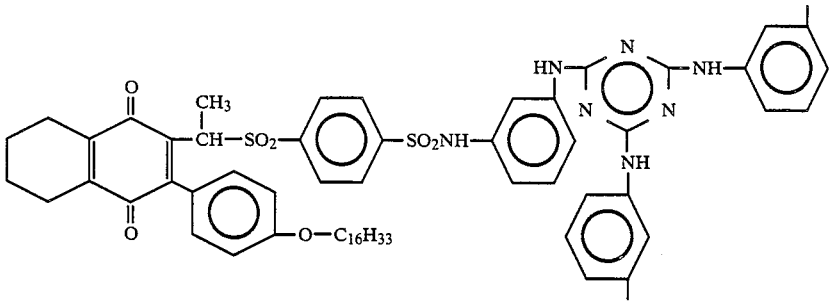
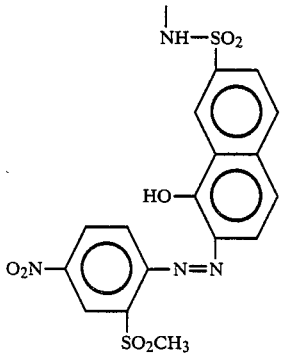
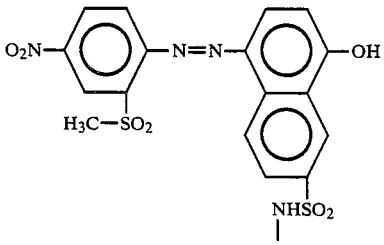
IHR-compound C 03

TABLE 3-continued
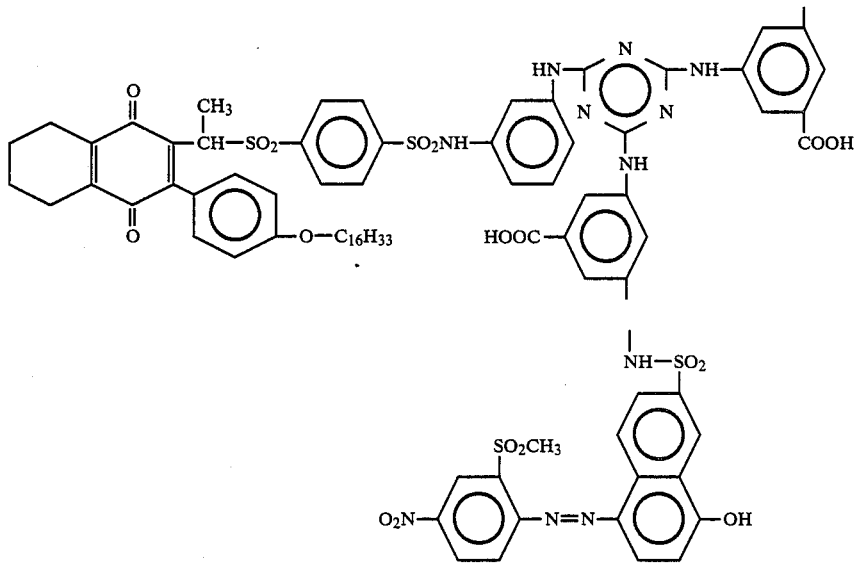
Examples of magenta bis-azo dye IHR-compounds comprising two identical magenta dye groups as PUG, which can be used advantageously according to the present invention, are listed in the following Table 4.
TABLE 4
IHR-compound M 01
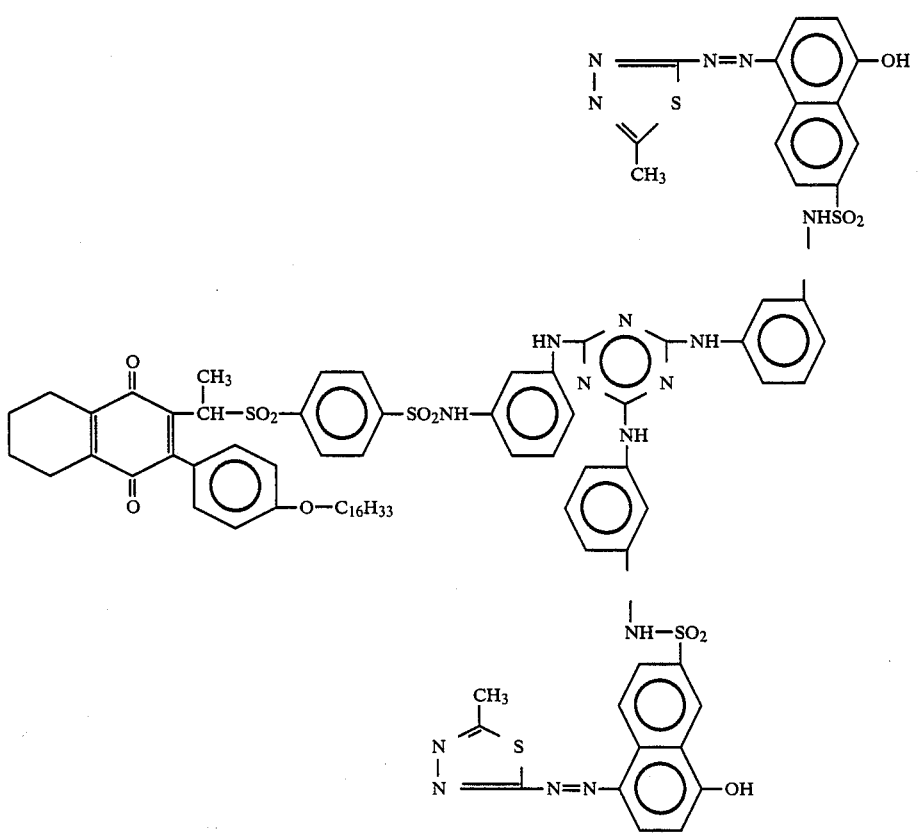

TABLE 4-continued
IHR-compound M 02
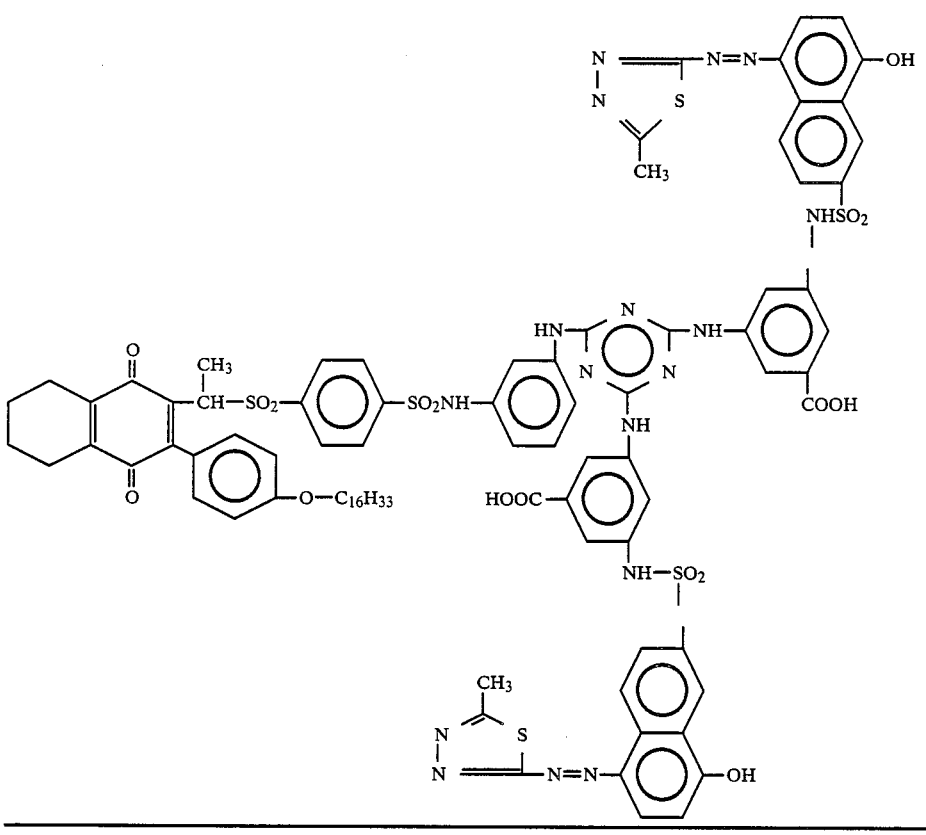
Examples of yellow bis-azo dye IHR-compounds comprising two identical yellow dye groups as PUG, which can be used advantageously according to the present invention, are listed in the following Table 5.
TABLE 5
IHR-compound Y 01
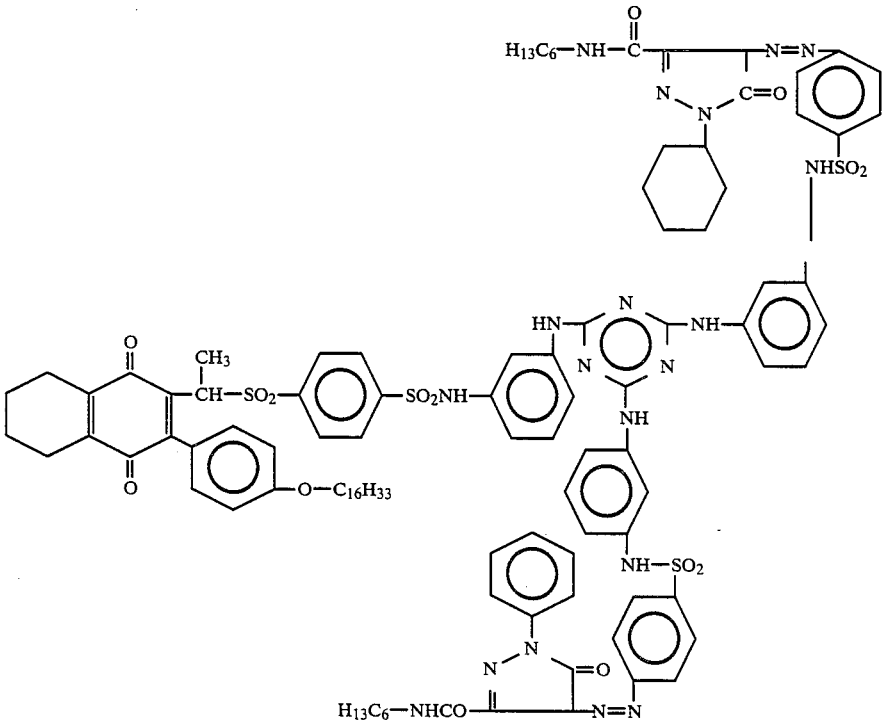

TABLE 5-continued
IHR-compound Y 02
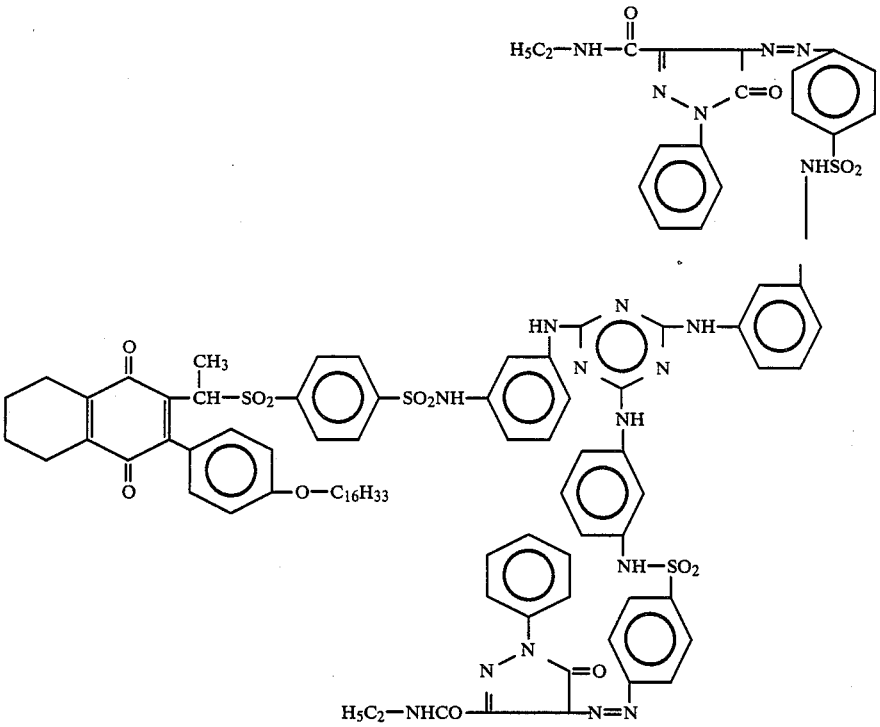
IHR-compound Y 03
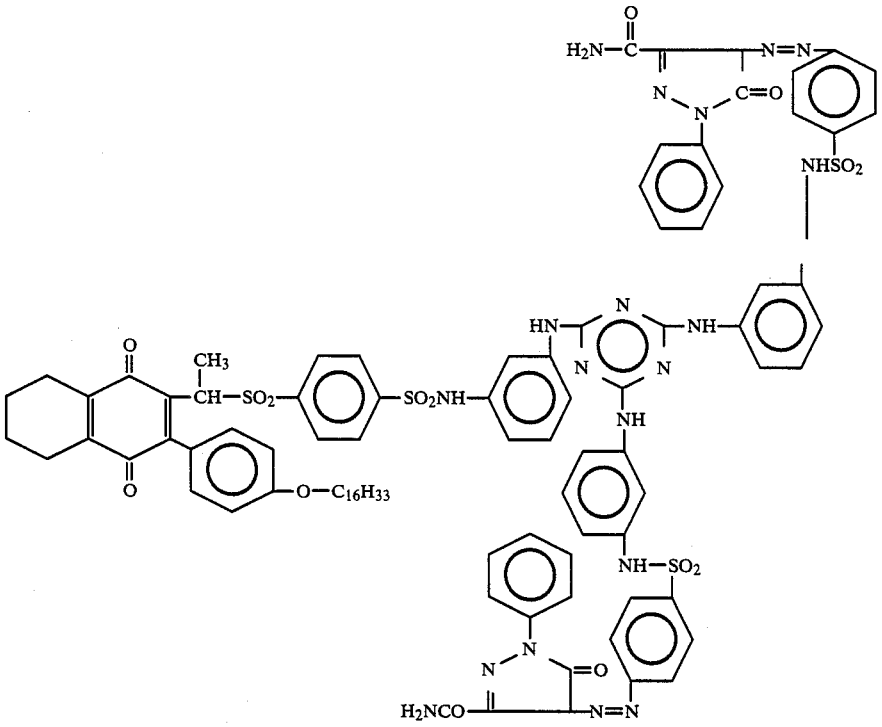
IHR-compound Y 04

TABLE 5-continued
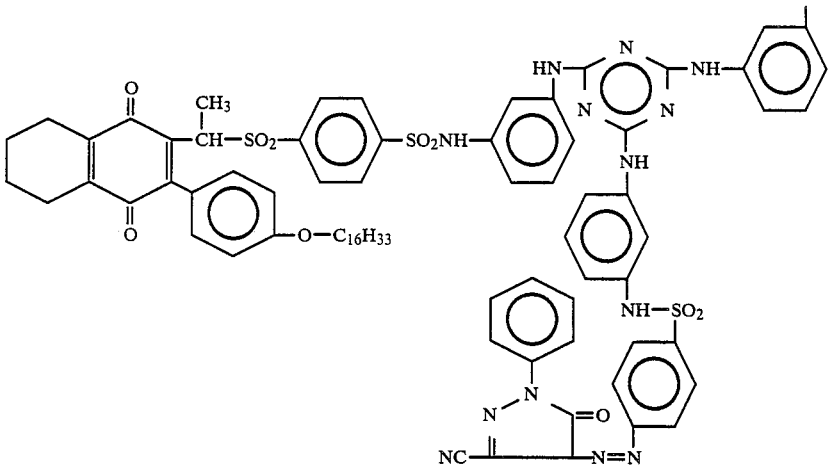
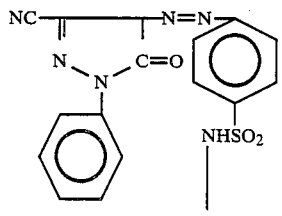
IHR-compound Y 05
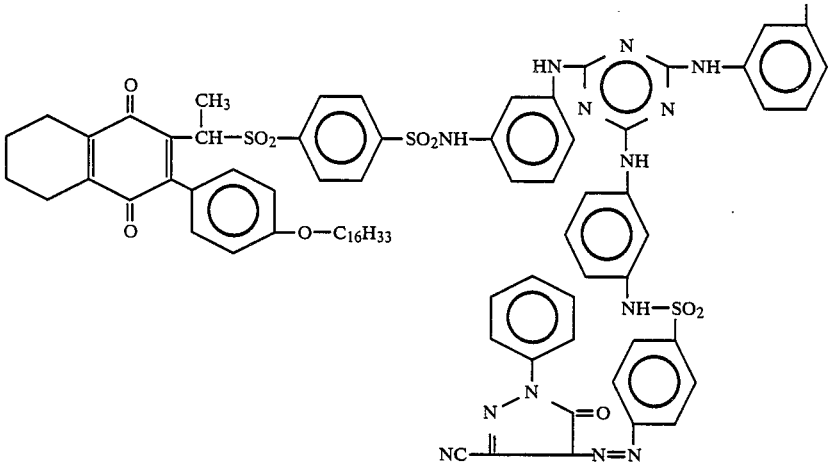
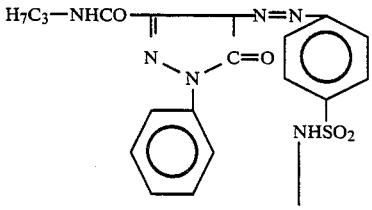
IHR-compound Y 06

TABLE 5-continued
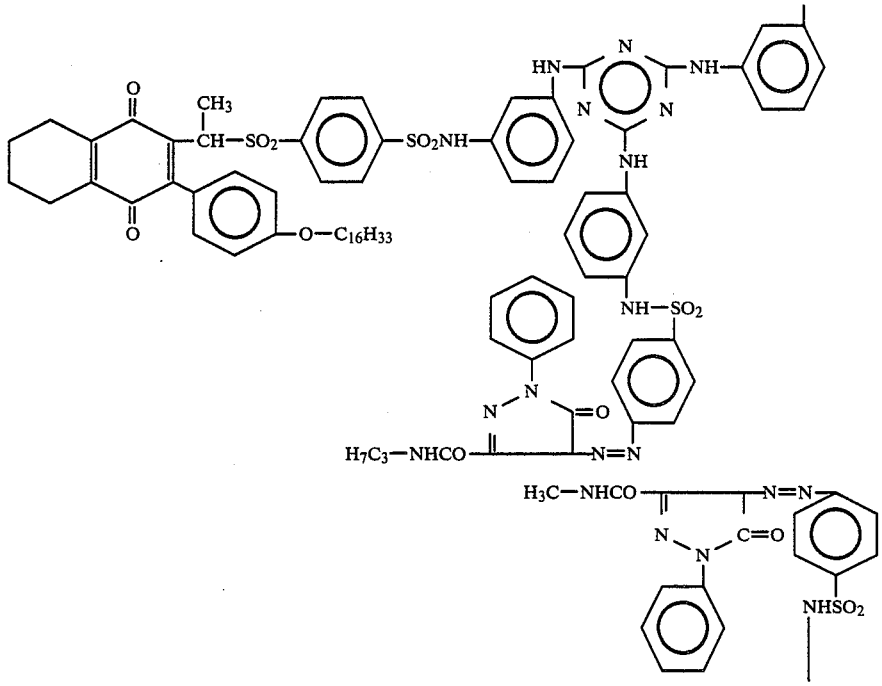
IHR-compound Y 07
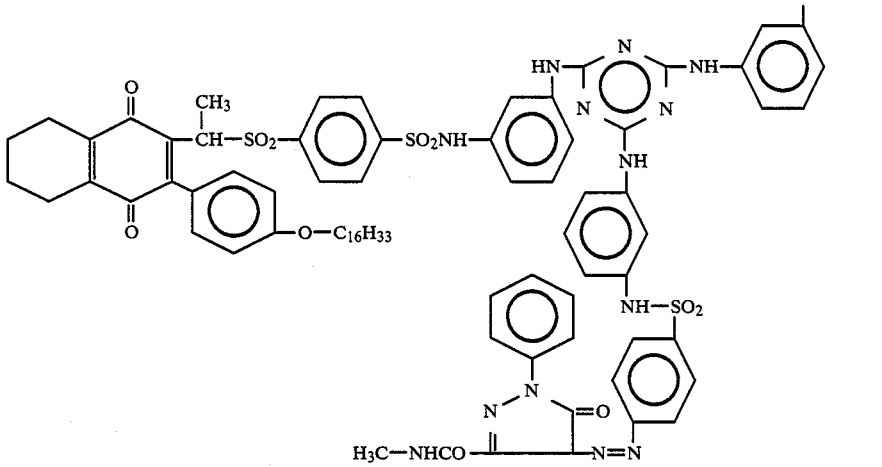
Examples of IHR-compounds comprising a dye group and a singlet oxygen scavenger group as two different PUG groups, which compounds can be used advantageously according to the present invention, are listed in the following Table 6.

TABLE 6
IHR-compound M/SOS 01
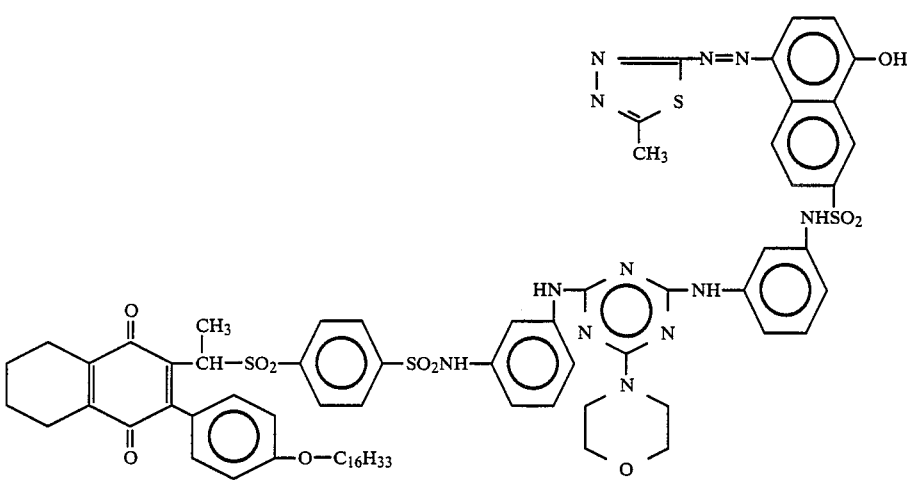
(magenta dye group/singlet oxygen scavenger group)
IHR-compound M/SOS 02
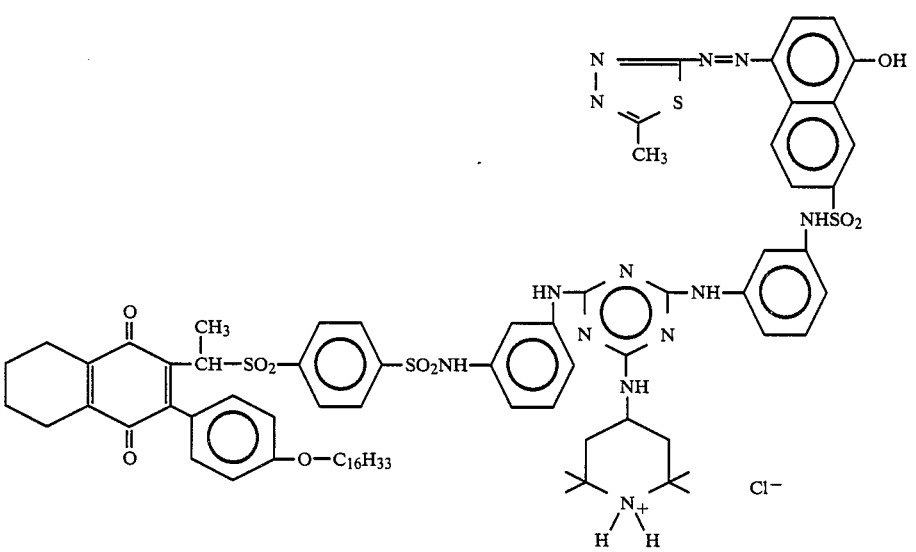
(magenta dye group/singlet oxygen scavenger group)
IHR-compound C/SOS 01
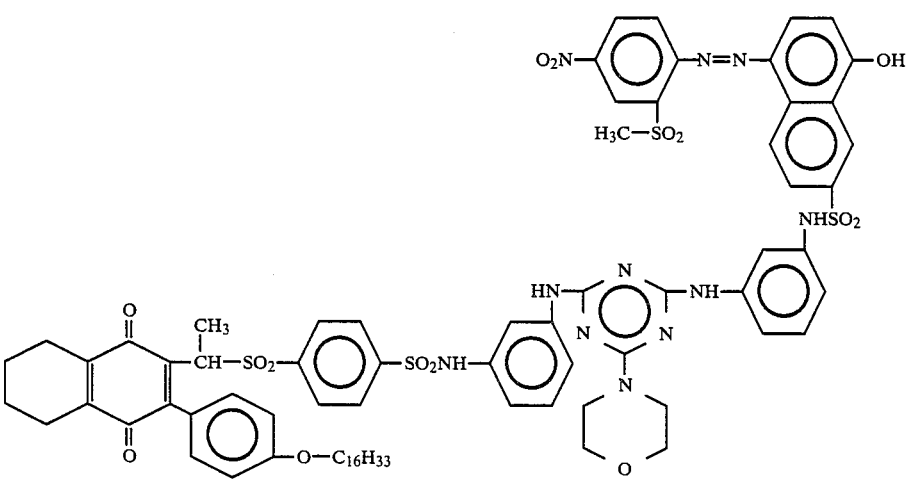
(cyan dye group/singlet oxygen scavenger group)

TABLE 6-continued

IHR-compound C/SOS 02

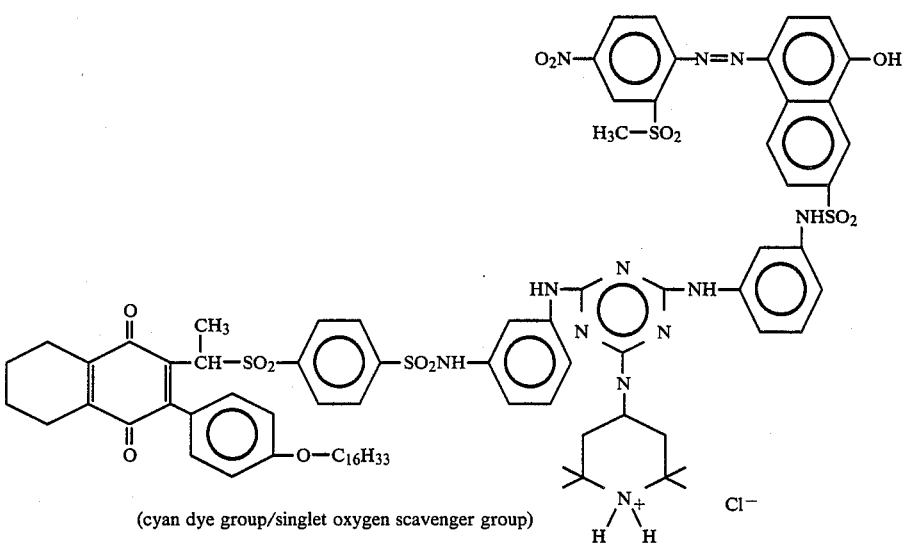

(cyan dye group/singlet oxygen scavenger group)

Examples of IHR-compounds comprising a dye group and an UV absorber group as two different PUG groups, which compounds can be used advantageously according to the present invention, are listed in the following Table 7.

TABLE 7

IHR-compound C/UV 01

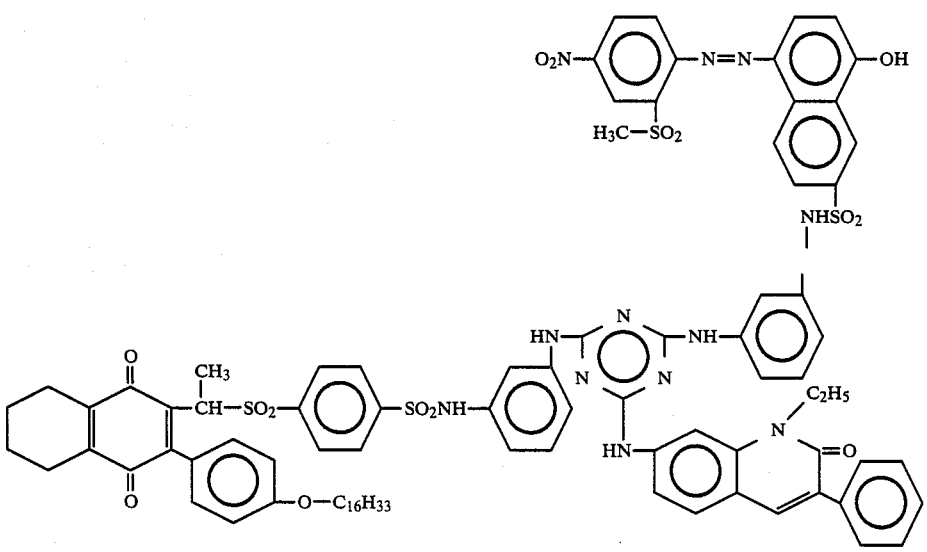

(cyan dye group/UV absorber group)

IHR-compound C/UV 02

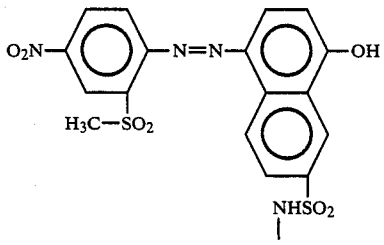

TABLE 7-continued

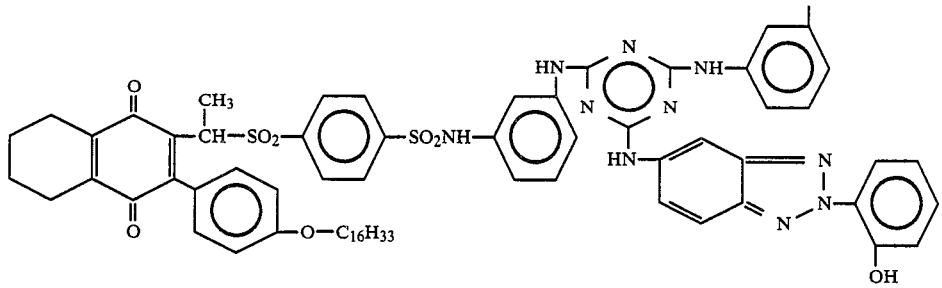

(cyan dye group/UV absorber group)

IHR-compound M/UV 01

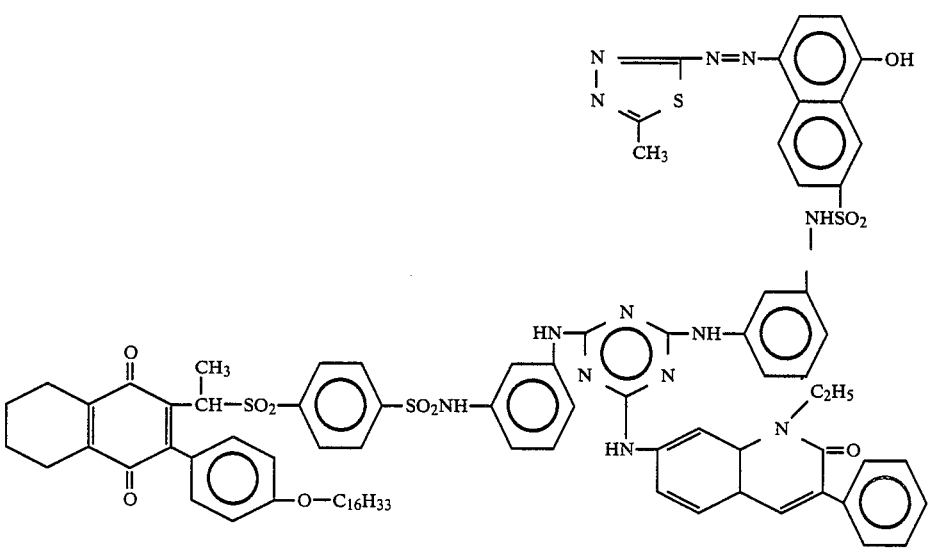

(magenta dye group/UV absorber group)

IHR-compound M/UV 02

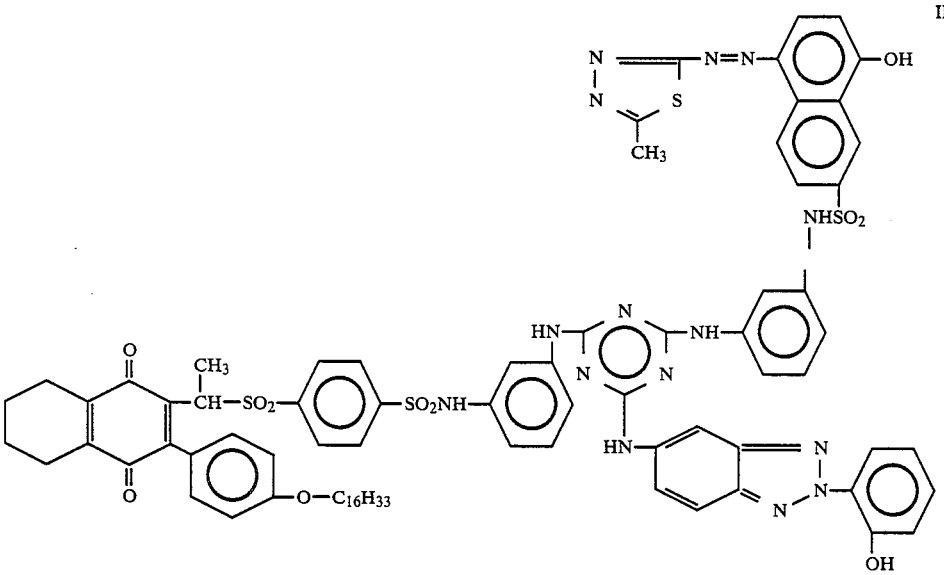

(magenta dye group/UV absorber group)

The following preparations illustrate the synthesis of particularly useful IHR-compounds according to the present invention having a quinonoid carrier part and a moiety comprising a s-triazine nucleus carrying two photographically useful groups.

An example of the preparation of an IHR-quinonoid compound comprising a s-triazine nucleus carrying as photographically useful groups two identical azo cyan dye groups is given in the following preparation 1.
PREPARATION 1: cyan dye-releasing IHR-compound C 01
Reaction scheme:
Step 1
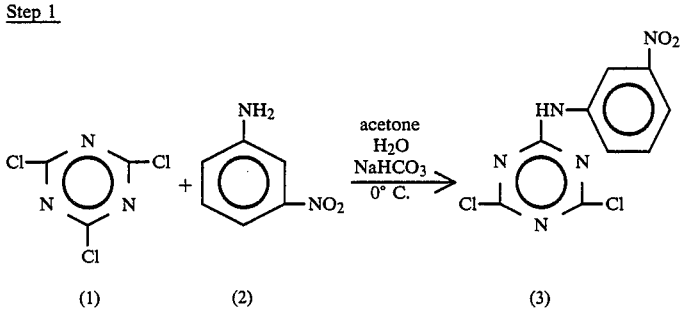
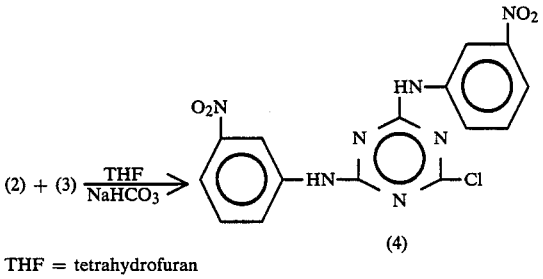
THF = tetrahydrofuran
Step 3
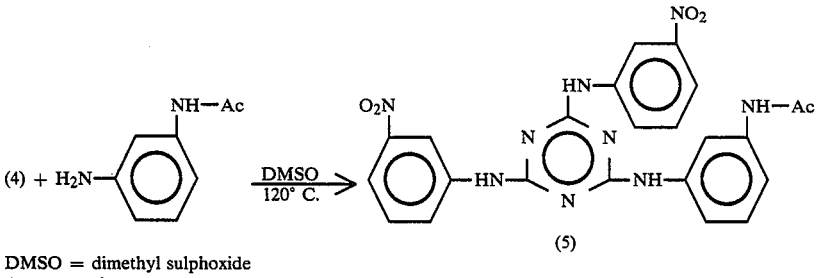
DMSO = dimethyl sulphoxide
Ac = acetyl
Step 4
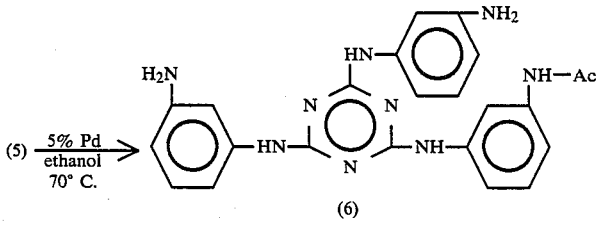
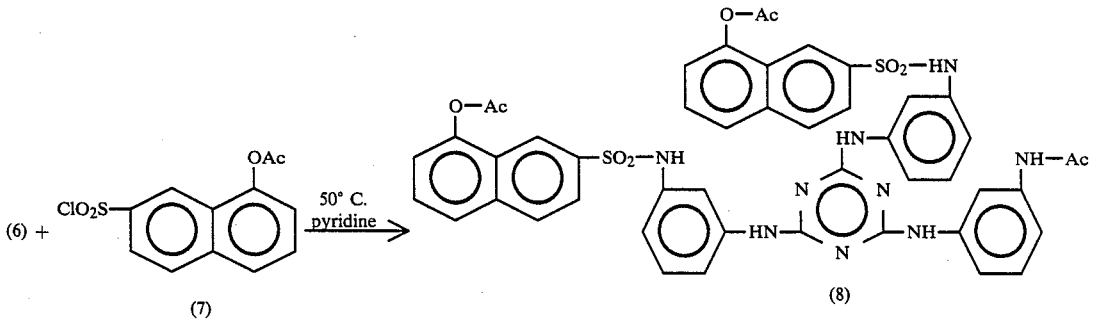
Step 6

-continued

Reaction scheme:

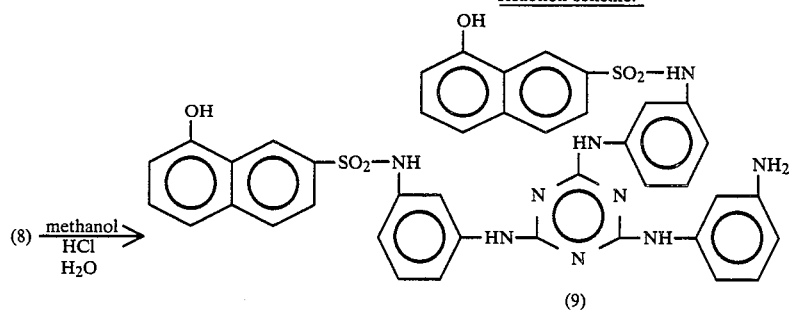

Step 7

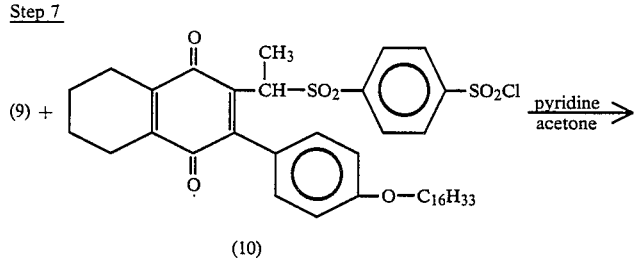

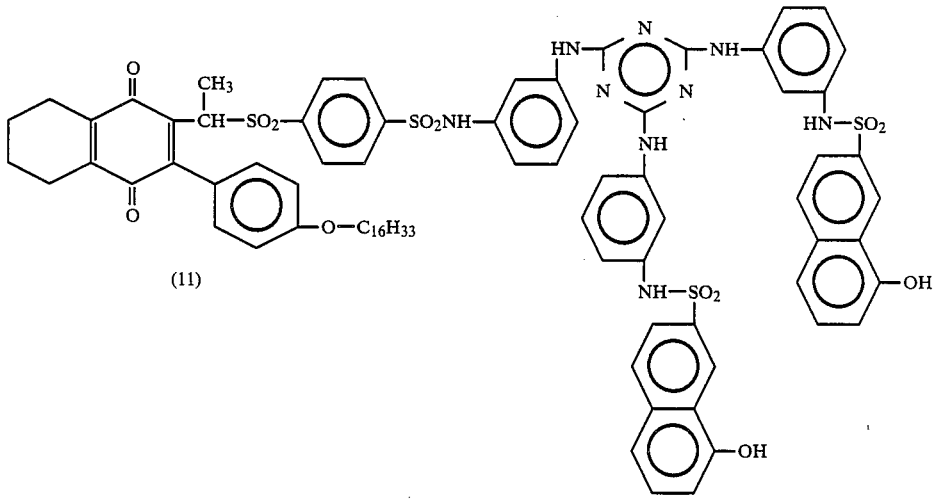

Step 8

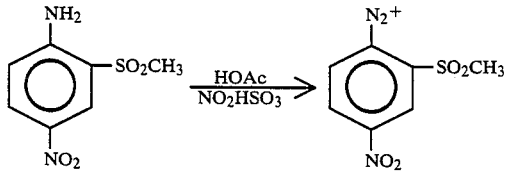

(13) + (11) $\xrightarrow[5-10° C.]{}$ IHR-compound C 01

Step 1

In a 10 l flask provided with a mechanical stirrer, a thermometer, and a dropping funnel 300 g of compound (1) are dissolved in 3 l of acetone at room temperature. A solution of 220 g of compound (2) in 1.5 l of acetone is added quickly at 0° C. A solution of 300 g of sodium hydrogen carbonate in 3 l of water is added slowly with stirring to the reaction mixture. Stirring is continued for 3 h at 0° C. The reaction product is filtered, dried, and then rinsed thrice with 1 l of distilled water. Finally, the reaction product is dried in a ventilated drying cabinet at 50° C. until a constant weight is obtained.

Yield: 441 g (95%) of compound (3) melting at 200.8° C.

Step 2

An amount of 200 g (0.7 mol) of compound (3) and 96.5 g (1 equivalent) of compound (2) is dissolved in 4 l of tetrahydrofuran. A volume of 2 l of a 10% aqueous solution of sodium hydrogen carbonate is added slowly. The reaction mixture is stirred for 24 h at room temperature. The resulting solution is poured out in 2 l of 5N hydrochloric acid with vigorous stirring. The reaction product is filtered off, rinsed with water until neutral, and dried at 50° C. until a constant weight is obtained.
Yield: 247.5 g (91%) of compound (4).

An amount of 40 g (0.1032 mol) of compound (4) and 30.97 g (2 equivalents) of 3-acetamido-aniline is dissolved in 300 ml of dimethyl sulphoxide. The reaction mixture is stirred for 3 h at 120° C., allowed to cool, and poured out in 1.5 l of water with vigorous stirring. The precipitate is filtered off, rinsed with water, and dried at 50° C. The product is rinsed again with water and dried in a drying cabinet at 30° C.
Yield: 430 g (81%) of compound (5).

Step 4

An amount of 20 g of compound (5) is hydrogenated in the presence of 0.5 g of 15% palladium catalyst in 240 ml of ethanol at 75°-80° C. for 8 h under a hydrogen pressure of 75 bar. The catalyst is filtered off and the reaction product is concentrated by evaporation.
Yield: 15.2 g (80%) of compound (6).

Step 5

A solution of 14.48 g (2.2 equivalents) of compound (7) in 50 ml of pyridine is added dropwise at 50° C. to a solution of 10.2 g (0.0232 mol) of compound (6) in 50 ml of pyridine. The reaction mixture is stirred for 1 h at 50° C., poured out in 800 ml of ice-cold 5N hydrochloric acid, and stirred for another hour. The reaction product is filtered with suction, rinsed with water until neutral, and dried at 25° C.
Yield: 17.2 g (79%) of compound (8).

Step 6

A volume of 7 ml of 5N hydrochloric acid is added to a solution of 7 g (0.00747 mol) of compound (8) in 30 ml of methanol. The reaction mixture is refluxed for 8 h. The reaction product starts precipitating after a while and is filtered with suction. Next, it is rinsed with water until neutral and dried at 25° C.
Yield: 4.2 g (67%) of compound (9).

Step 7

A volume of 3 ml of pyridine and 2 ml of water is added slowly dropwise at 50° C. to a solution of 4 g (0.00493 mol) of compound (9) in 20 ml of acetone. An amount of 3.671 g (1.2 equivalent) of compound (10) is added to the resulting solution. The reaction mixture is stirred for 45 min, poured out in 800 ml of ice-cold 5N hydrochloric acid, and stirred for 1 h. The reaction product is filtered with suction, rinsed with water until neutral, and dried at 25° C.
Yield: 7.4 g (98%) of compound (11).

Step 8

An amount of 4 g (0.0185 mol) of compound (12) is suspended in 26 ml of acetic acid. A volume of 2.9 ml of concentrated sulphuric acid at 20° C. is added so that dissolution occurs. A volume of 3.1 ml of $NO_2.HSO_3$ (40% in sulphuric acid) at 15° C. is added dropwise very slowly to the solution. The resulting diazonium solution comprising compound (13) is stirred for 30 min.

A solution of 4.8 g (0.003159 mol) of compound (11) in 20 ml of methyl cellosolve acetate is cooled to 5° C. A volume of 13.7 ml (2.5 equivalents) of the diazonium solution comprising compound (13) is added dropwise with continuous stirring at 5°-10° C. to the solution of compound (11). The mixture is allowed to stand overnight and then poured out on ice. The reaction product is filtered with suction, rinsed with water until neutral, and dried under reduced pressure. An amount of 1.8 g of reaction product is recrystallized from 20 ml of methylene chloride/methanol (90:10) and allowed to stand for 4 h. The precipitate is filtered with suction, rinsed with methylene chloride, and dried under reduced pressure.
Yield: 1.2 g of IHR-compound C 01.

An example of the preparation of an IHR-quinonoid compound comprising a s-triazine nucleus carrying as photographically useful groups two identical yellow dye groups is given in the following preparation 2.

PREPARATION 2: yellow dye-releasing IHR-compound Y 01

The steps 1 to 3 of the preparation of dye-releasing compound C 01 are repeated and the subsequent procedure is according to the following reaction scheme:

Reaction scheme:

Step 4

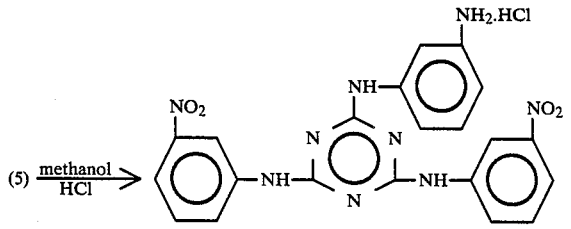

(14)

Step 5

-continued

Reaction scheme:

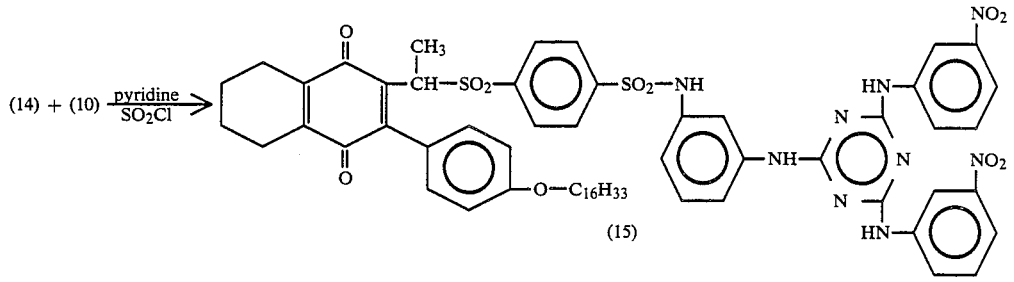

Step 6

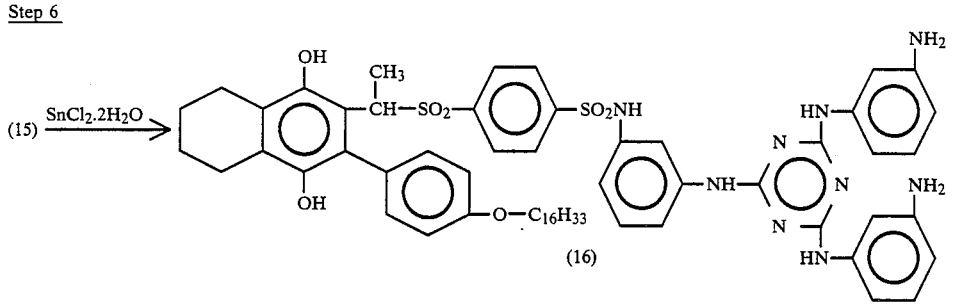

Step 7

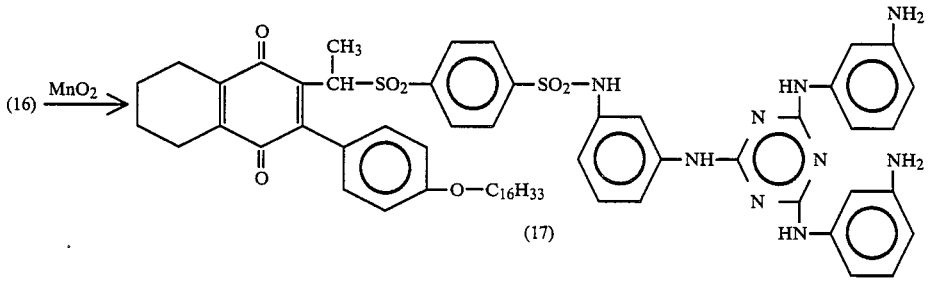

Step 8

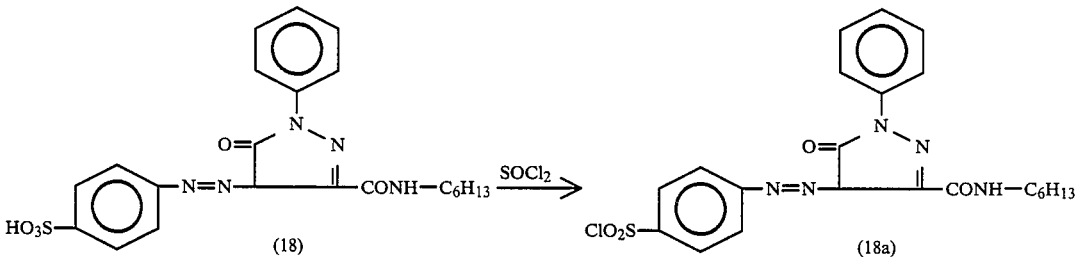

Step 9

(17) + (18a) ⟶ IHR-compound Y 01

Step 4

A volume of 200 ml of concentrated hydrochloric acid and 50 ml of water is added slowly to a stirred solution of 50 g (0.1 mol) of compound (5) in 500 ml of methanol at 80° C. The reaction mixture is allowed to cool down to room temperature so that the reaction product precipitates. The precipitate is filtered with suction, rinsed with water until neutral, and dried at 25° C.

Yield: 43.4 g (88%) of compound (14).

Step 5

An amount of 150.3 g (1 equivalent) of compound (10) is added with stirring to a solution of 100 g (0.20 mol) of compound (14) in 600 ml of pyridine at 50° C. To the reaction mixture 15.0 g (0.1 equivalent) of compound (10) is added. The resulting mixture is poured out slowly with thorough stirring in 1 l of icecold 12N hydrochloric acid. The reaction product is filtered with suction, rinsed thoroughly with water until neutral, and dried at 25°-50° C. The product is added to pyridine again. An amount of 45.0 g (0.3 equivalent) of compound (10) is added again. The mixture is kept at 50° C. for 3 h, then poured out slowly with stirring in icecold 12N hydrochloric acid. The reaction product is filtered with suction, rinsed thoroughly with water until neutral, and dried at 30° C.

Yield: 275.0 g of compound (15).

Step 6

An amount of 14.0 g (0.01199 mol) of compound (15) in 210 ml of ethanol is added to 140 ml of tetrahydrofuran. An amount of 18.2 g of $SnCl_2.2\ H_2O$ is added to the resulting solution. The reaction mixture is refluxed for 3 h and then poured out in 1400 ml of ethyl acetate. The pH of the mixture is adjusted to 9 by means of sodium hydrogen carbonate. The reaction product is filtered with suction, the Sn-salts are removed, and the product is rinsed with ethyl acetate. The organic phase is separated and rinsed with a saturated aqueous sodium chloride solution. The reaction product (16) is dried over sodium sulphate and concentrated by evaporation to a volume of approximately 100 ml.

Step 7

An amount of 17.4 g (15 equivalents) of $MnO_2$ is added to compound (16). The mixture is refluxed for 1 h. The $MnO_2$ is filtered off and the reaction product is concentrated by evaporation under reduced pressure until dry.

Yield: 9.7 g of compound (17).

Step 8

A solution of 9 g (0.0189 mol) of compound (18) in 63 ml of dry toluene and 0.8 ml of dimethylformamide is heated to 70° C. A volume of 6.9 ml (5 equivalents) of thionyl chloride is added slowly. The reaction mixture is stirred for 30 min. Thionyl chloride is removed by evaporation. The reaction product is concentrated by evaporation, rinsed 4 times with water, and dried.

Step 9

An amount of 10 g (0.009032 mol) of freshly prepared compound (17) is dissolved in 80 ml of pyridine at 50° C. A solution of 2.1 equivalents of compound (18*a*) in 100 ml of pyridine is added dropwise. After 1 h a further volume of 1 equivalent of compound (18*a*) in 50 ml of pyridine is added. The reaction mixture is allowed to stand overnight and next poured out in icewater with stirring. The reaction product is filtered with suction, rinsed with water until neutral, and dried at 25° C.

Yield: 17.3 g (95%) of IHR-compound Y 01.

Examples of the preparation of IHR-quinonoid compounds comprising a s-triazine nucleus carrying as photographically useful groups one dye group and one singlet oxygen scavenger group are given in the following preparation examples 3 to 6.

PREPARATION 3: cyan dye-releasing IHR-compound C/SOS 01

Step 1 of the preparation of dye-releasing compound C 01 is repeated and the subsequent procedure is according to the following reaction scheme:

Reaction scheme:

Step 2

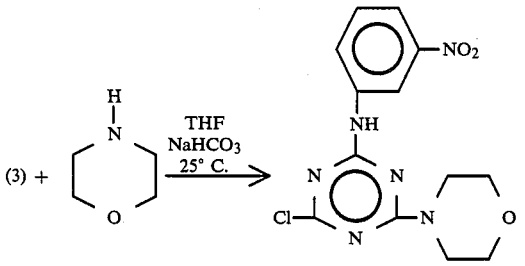

Step 3

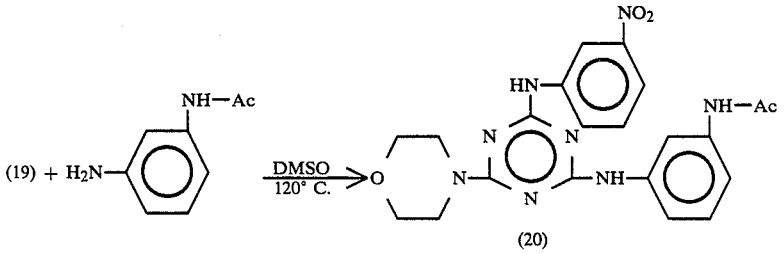

Step 4

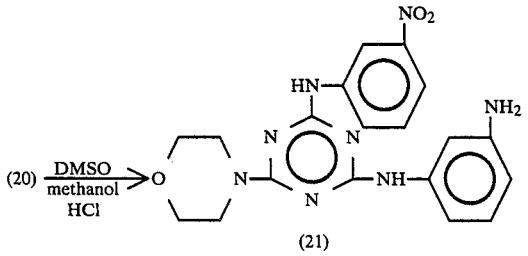

Step 5

-continued

Reaction scheme:

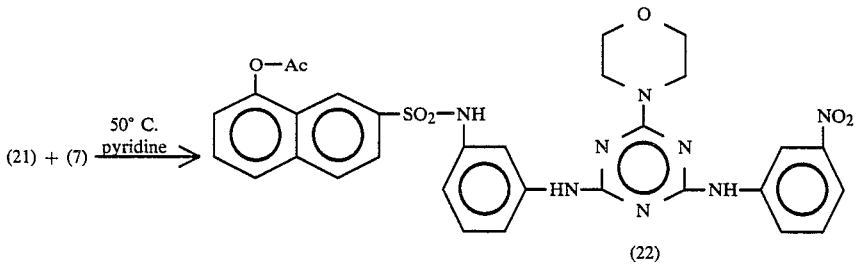

Step 6

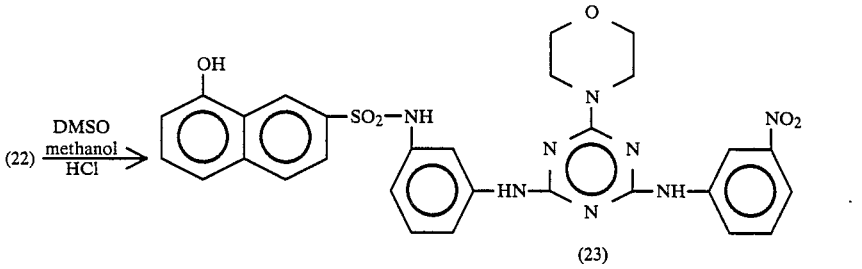

Step 7

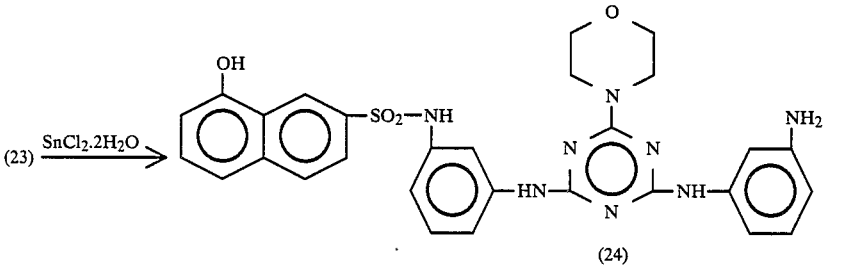

Step 8

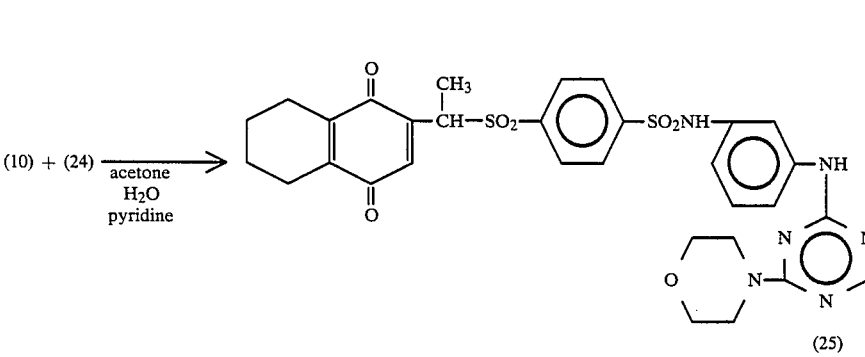

Step 9

(13) + (25) $\xrightarrow[5\text{-}10^\circ\ C.]{}$ IHR-compound C/SOS 01

Step 2

An amount of 50 g of compound (3) is placed in a 2 l flask provided with a mechanical stirrer and a dropping funnel. A volume of 900 ml of tetrahydrofuran at room temperature is added thereto and 15.23 ml of morpholine is added with stirring to the solution. A solution of 50 g of sodium hydrogen carbonate in 500 ml of distilled water is added slowly with thorough stirring in 15 min to the solution. The reaction mixture is stirred for 2 h. The reaction product is filtered on a Büchner, rinsed 5 times with 100 ml of distilled water, and dried in a drying cabinet at 50° C. until a constant weight is obtained. Yield: compound (19) melting at 250.7° C.

Step 3

An amount of 50 g (0.1486 mol) of compound (19) and 44.6 g of 3-acetamido-aniline (2 equivalents) is dissolved in 600 ml of dimethyl sulphoxide. The reaction mixture is stirred for 12 h at 120° C., poured out in 2 l of water whilst slowly stirring, and cooled quickly with icewater. The reaction product is filtered with suction, rinsed with water until neutral, and dried at 25° C.
Yield: 46.1 g (69%) of compound (20).

Step 4

To a solution of 45 g (0.1 mol) of compound (20) in 400 ml of dimethyl sulphoxide are added 40 ml of methanol and 80 ml of concentrated 5N hydrochloric acid. The reaction mixture is refluxed for 7 h, allowed to stand overnight, and refluxed again for 3 h. The reaction mixture is poured out in 2 l of icewater. The reaction product is filtered with suction, rinsed with water, and dried at 50° C.
Yield: 40.4 g (99%) of compound (21).

Step 5

An amount of 27.9 g of solid compound (7) is added with stirring to a solution of 40.0 g (0.098 mol) of compound (21) in 300 ml of pyridine at 50° C. The reaction mixture is stirred for 45 min at 50° C. and poured out in 1 l of ice-cold 5N hydrochloric acid. The reaction product is filtered with suction, rinsed thrice with 200 ml of water until neutral, and dried at 50° C.
Yield: 65.2 g (98%) of compound (22).

Step 6

To a solution of 64.0 g of compound (22) in 150 ml of dimethyl sulphoxide are added 150 ml of methanol and 25 ml of concentrated 5N hydrochloric acid. The reaction mixture is refluxed for 2 h. The reaction mixture is poured out in 2 l of icecold 1N hydrochloric acid. The reaction product is filtered with suction, rinsed with water until neutral, and dried at 50° C.
Yield: 50.2 g (84%) of compound (23).

Step 7

A solution of 49.5 g (0.0806 mol) of compound (23) in 500 ml of ethanol and 90 g of $SnCl_2.2\ H_2O$ are refluxed for 1 h. The reaction mixture is poured out in 1 l of ethyl acetate. The pH-value of the mixture is adjusted to 12 by means of 10% aqueous sodium carbonate and 360 g of celite is added. The mixture is stirred thoroughly. The Sn salts are filtered off and rinsed thoroughly thrice with 150 ml of ethyl acetate. The aqueous layer is removed and the organic phase is rinsed twice with 150 ml of a saturated aqueous sodium chloride solution. The reaction product is dried over 300 g of sodium sulphate, concentrated by evaporation, and dried at 50° C.
Yield: 32.8 g (69%) of compound (24).

Step 8

A volume of 25.8 ml of pyridine and 9.3 ml of water is added to a solution of 31 g (0.0531 mol) of compound (24) in 93 ml of acetone. An amount of 41.5 g (1.05 equivalent) of compound (10) is added to the resulting solution. The reaction mixture is poured out in ice-cold 5N hydrochloric acid and stirred slowly until precipitation starts. The reaction product is filtered with suction, rinsed with 2N hydrochloric acid and next with water until neutral. The reaction product is dried at 25° C.
Yield: 63.4 g (92%) of compound (25).

Step 9

A solution of 20 g (0.01547 mol) of compound (25) in 86 ml of methyl cellosolve acetate is cooled to 5°-10° C. A volume of 32.6 ml (1.3 equivalent) of compound (13) is added dropwise thereto. The reaction mixture is poured out on ice. The reaction product is filtered with suction and rinsed with water.
Yield: 7.4 g of IHR-compound C/SOS 01.

PREPARATION 4: magenta dye-releasing IHR-compound M/SOS 01

Steps 1 to 8 are identical to those described in Preparation 3 and step 9 is according to the following reaction scheme:

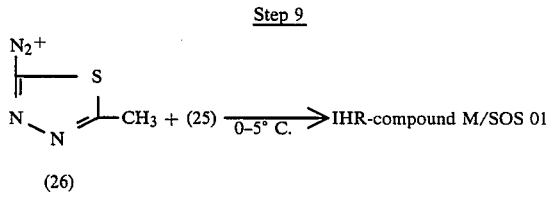

Step 9

A solution of 20 g (0.01547 mol) of compound (25) in 120 ml of methyl cellosolve acetate is cooled to 0°-5° C. A volume of 40 ml (1.5 equivalent) of compound (26) is added. The reaction mixture is stirred for 1 h.
Yield: 15.0 g of IHR-compound M/SOS 01.

PREPARATION 5: cyan dye-releasing IHR-compound C/SOS 02

Step 1 of the preparation of dye-releasing compound C 01 is repeated and the subsequent procedure is according to the following reaction scheme:

Step 2

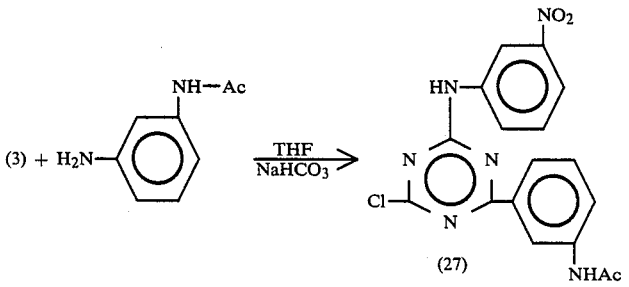

Step 3

-continued
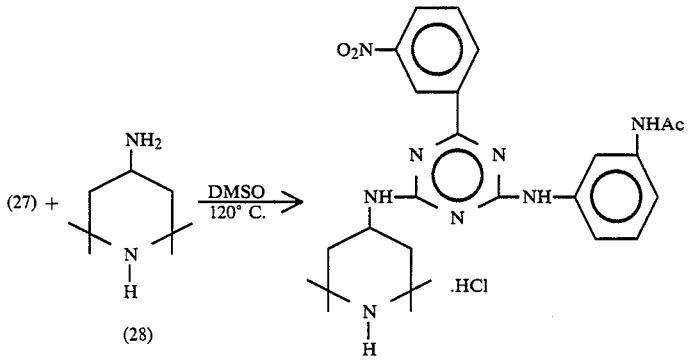
Step 4
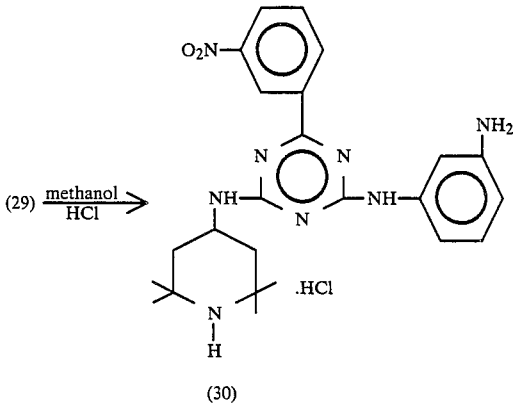
Step 5
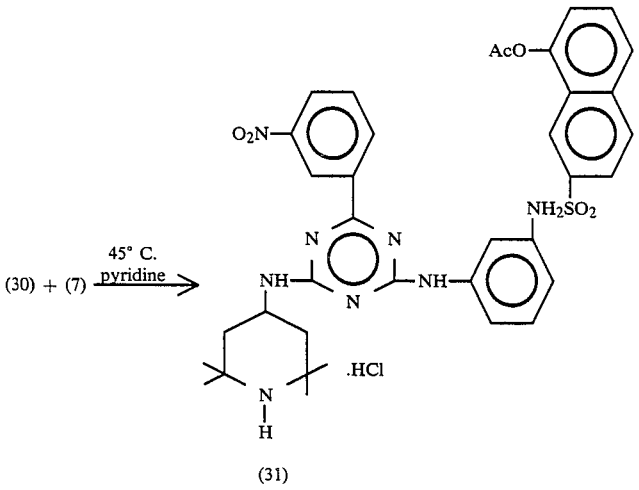
Step 6

-continued

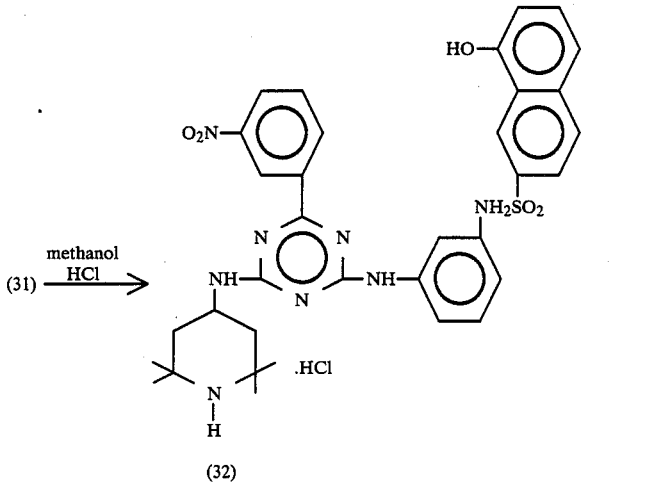

Step 7

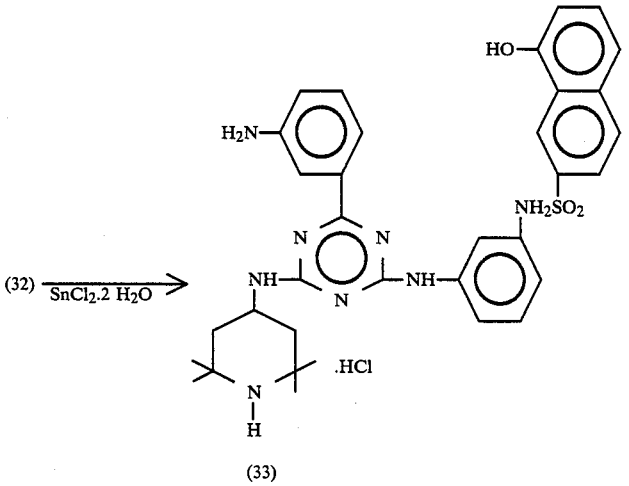

Step 8

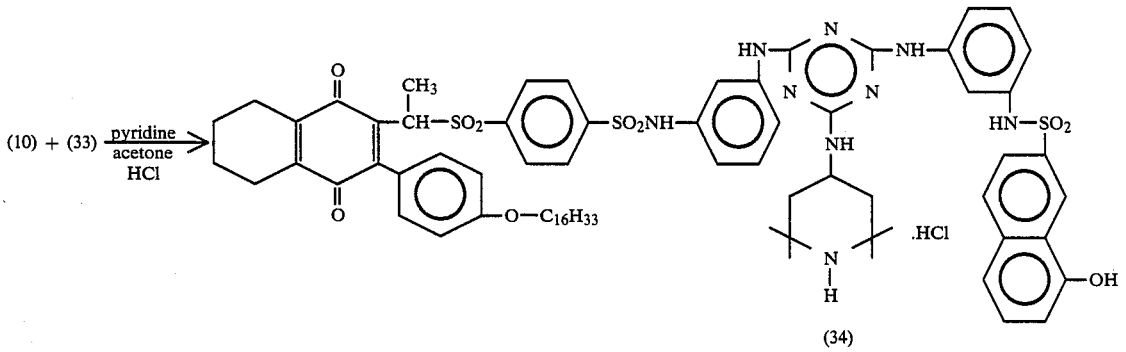

Step 9

(13) + (34) ⟶ IHR—compound C/SOS O2

Step 2

An amount of 100 g (0.3497 mol) of compound (3) is placed in a flask provided with a mechanical stirrer and a dropping funnel. An amount of 52.45 g of 3-acetamido-aniline is added. A volume of 1.5 l of tetrahydrofuran is added to the reagents. A volume of 1 l of a 10% aqueous solution of sodium hydrogen carbonate is added with stirring at room temperature. After a reaction time of 16 h the reaction product is filtered with suction, rinsed 5 times with water, and dried for 24 h in a drying cabinet at 50° C.

Yield: 107.7 g (77%) of compound (27).

Step 3

An amount of 41 g of compound (27) is dissolved in 400 ml of dimethyl sulphoxide in a 1 l flask provided with a funnel, a mechanical stirrer, and a thermometer. The temperature of the reaction mixture is increased to 120° C. A volume of 34.8 ml of compound (28) is added in 5 min through the funnel. The reaction mixture is stirred for 3 h at 120° C. and then poured out in 2 l of icecold water with slow stirring. The stirring is continued for 2 h. The reaction mixture is filtered wth suction. The reaction product is placed in a 2 l flask and 500 ml of water is added thereto. A volume of 500 ml of hydrochloric acid is added. The reaction mixture is refluxed until a filterable precipitate is obtained in about 30 min. The cold precipitate is filtered with a Buchner funnel, rinsed twice with 500 ml of water until neutral, and dried in a ventilated drying cabinet at 25° C. until a constant weight is obtained.

Yield: 42.5 g (74%) of compound (29).

Step 4

A volume of 100 ml of 6N hydrochloric acid is added to a solution of 42 g (0.0756 mol) of compound (29) in 1 l of methanol. The reaction mixture is refluxed vigorously for 16 h. Upon cooling to room temperature the reaction product partially precipitates. The methanol is removed by evaporation. The reaction product is filtered with suction and dried at 50° C.

Yield: 40.2 g (96%) of compound (30).

Step 5

An amount of 26.9 g of solid compound (7) is added at once to a solution of 40.0 g (0.07273 mol) of compound (30) in 200 ml of pyridine. The reaction mixture is stirred for 45 min, then poured out in a mixture of hydrochloric acid and ice, and stirred until solidification. The product is filtered, rinsed thrice with 100 ml of water, and dried at 50° C.

Yield: 60 g (92%) of compound (31).

Step 6

A volume of 120 ml of 5N hydrochloric acid is added to a solution of 60 g (0.0788 mol) of compound (31) in 180 ml of methanol. The reaction mixture is refluxed vigorously for 4 h and next poured out in 2 l of 1N hydrochloric acid. The reaction product is filtered with suction, rinsed thoroughy with water, and dried at 50° C.

Yield: 47.5 g (84%) of compound (32).

Step 7

A solution of 47.5 g (0.06603 mol) of compound (32) in 450 ml of ethanol and 90 g of $SnCl_2.2\ H_2O$ are refluxed vigorously and next poured out in 750 ml of ethyl acetate. The pH-value of the reaction mixture is adjusted to 12 by means of 1250 ml of a 10% aqueous sodium carbonate solution and 360 g of celite is added. The gel is rinsed four times with 200 ml of ethyl acetate. The aqueous layer is removed and the organic phase is rinsed twice with saturated aqueous sodium chloride solution. The reaction product is dried over 800 g of sodium sulphate, concentrated by evaporation, and dried at 25° C.

Yield: 35.2 g (81%) of compound (33).

Step 8

A volume of 58 ml of 1N hydrochloric acid is added to a solution of 35 g (0.0536 mol) of compound (33) in 225 ml of acetone. Next, 21.8 ml of pyridine and 41.9 g of solid compound (10) are added thereto. The reaction mixture is stirred for 90 min at 50° C. and poured out on a mixture of ice and 100 ml of 5N hydrochloric acid. The reaction product is filtered with suction, rinsed with water, and dried at 25° C.

Yield: 68.8 g (91%) of compound (34).

Step 9

A volume of 22.76 ml (1.4 equivalent) of compound (13) is added dropwise to a solution of 13 g (0.0193 mol) of compound (34) in 56 ml of methyl cellosolve acetate, the first drops being added at room temperature and the remainder being added at 5° C. The mixture is allowed to react overnight. The reaction mixture is poured out on 1.5 l of icewater and stirred until all ice has melted. The reaction product is filtered with suction, rinsed with acetonitrile, then rinsed with water until neutral, rinsed again with acetonitrile, and dried at 25° C.

Yield: 12.5 g (81%) of IHR-compound C/SOS 02.

PREPARATION 6: magenta dye-releasing IHR-compound M/SOS 02

Steps 1 to 8 are identical to those described in Preparation 5 and step 9 is according to the following reaction scheme:

Step 9

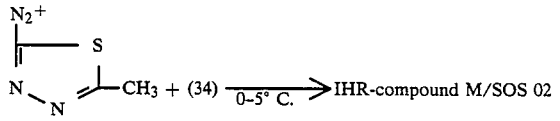

(26)

A solution of 15 g (0.01073 mol) of compound (34) in 180 ml of methyl cellosolve acetate is cooled to 0°-5° C. A volume of 25.5 ml (1.5 equivalent) of compound (26) is added dropwise. The reaction mixture is stirred for 90 min at 0° C. and poured out on 1 l of icewater. The reaction product is filtered with suction, rinsed 6 times with acetonitrile, and dried at 30° C.

Yield: 15.4 g (94%) of IHR-compound M/SOS 02.

Examples of the preparation of IHR-quinonoid compounds comprising a s-triazine nucleus carrying as photographically useful groups one dye group and one UV absorber group are given in the following preparation examples 7 to 10.

PREPARATION 7: cyan dye-releasing IHR-compound C/UV 01

Reaction scheme:

Step 1

-continued
Reaction scheme:
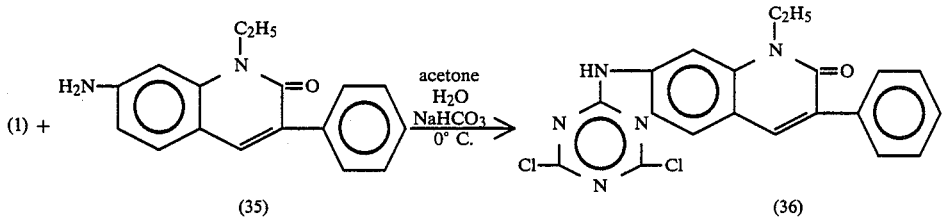
Step 2
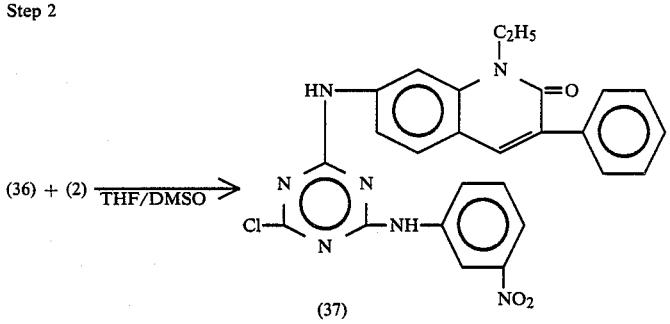
Step 3
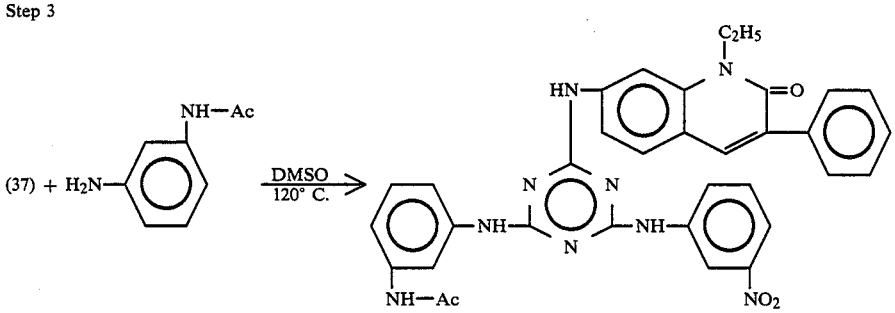
Step 4
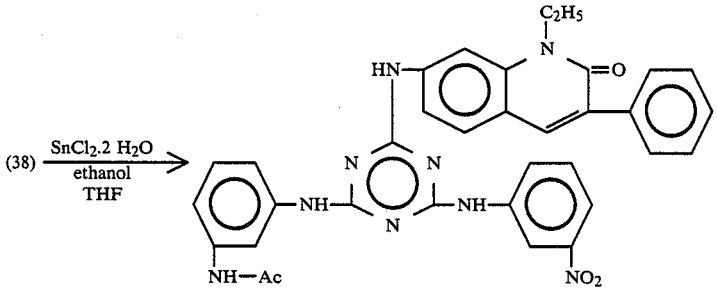
Step 5
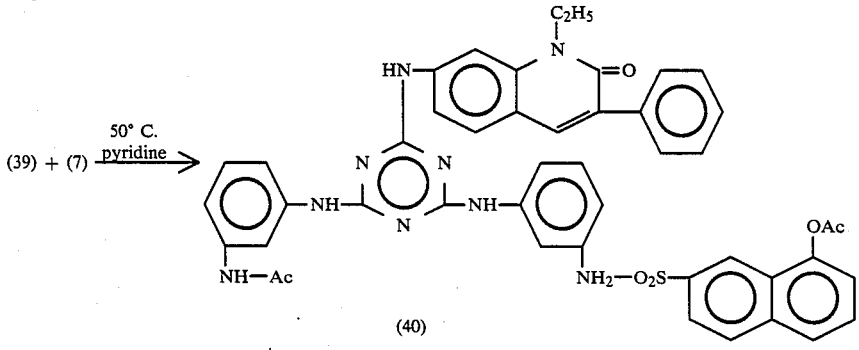

-continued

Reaction scheme:

Step 6

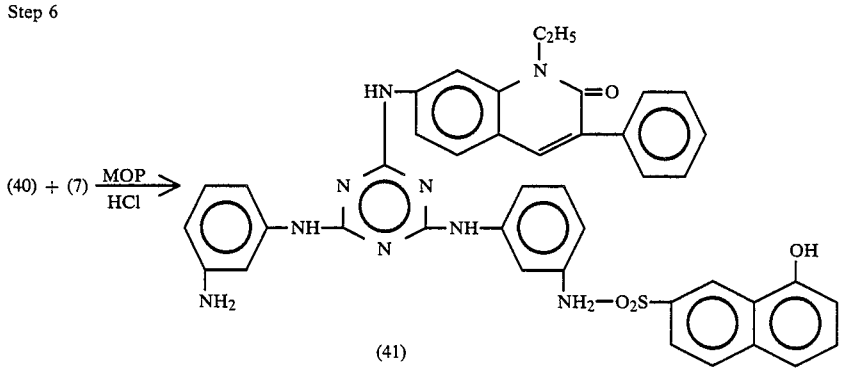

(41)

MOP = 1-methoxy-2-propanol

Step 7

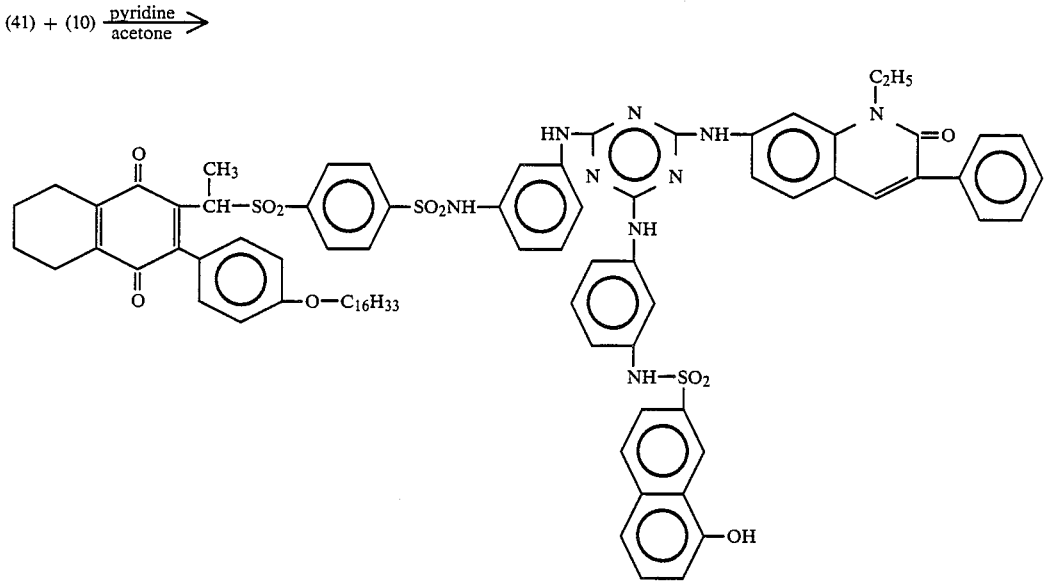

(42)

Step 8

(13) + (42) ⟶ IHR—compound C/UV 01

Step 1

A solution of 100 g (0.54 mol) of compound (1) in 1 l of acetone is added at 0° C. to a solution of 143.1 g of compound (35) in 1 l of acetone. A volume of 1.5 l of a 10% aqueous solution of sodium hydrogen carbonate is added thereto. The reaction product slowly deposits. The mixture is stirred for 4 h. The reaction product is filtered with suction, rinsed 5 times with 1 l of water, then rinsed thrice with acetone, and dried at 50° C. in a ventilated drying cabinet.

Yield: 203.4 g (91%) of compound (36).

Step 2

To a solution of 100 g (0.243 mol) of compound (36) in 1.5 l of dimethyl sulphoxide are added with stirring for 24 h at room temperature 1 l of tetrahydrofuran, 33.5 g (1 equivalent) of compound (2), 100 g of sodium hydrogen carbonate, and 250 ml of water. The reaction mixture is stirred for 30 h and then poured out slowly in 10 l of icewater and 250 ml of concentrated hydrochloric acid. The reaction mixture is stirred for 1 h. The precipitate is filtered, rinsed with water until neutral, and dried at 50° C.

Yield: 101.2 g (81%) of compound (37).

Step 3

An amount of 100 g (0.195 mol) of compound (37) and 29.21 g (1 equivalent) of 3-acetamido-aniline is dissolved in 600 ml of dimethyl sulphoxide. A solution of 100 g of sodium hydrogen carbonate in 100 ml of water is added with stirring for 4 h at 120° C. The reaction mixture is poured out in 8 l of icewater and 250 ml of concentrated hydrochloric acid. The reaction product is filtered with suction, rinsed twice with 1 l of methanol, and dried under reduced pressure.

Yield: 119.2 g (95%) of compound (38).

Step 4

To a solution of 100 g (0.1595 mol) of compound (38) in 1000 ml of tetrahydrofuran are added 1000 ml of ethanol and 130 g of $SnCl_2.2\ H_2O$. The mixture is refluxed for 2 h and 1 l of ethyl acetate is added thereto. The pH of the reaction mixture is adjusted to 9 by means of 6 l of saturated aqueous solution of sodium hydrogen carbonate. The reaction mixture is stirred vigorously. A large amount of celite is added. The Sn-salts are filtered off. The product is divided in 4 portions, which are rinsed first with 1 l of ethyl acetate and next with a sodium chloride solution. The organic phases are collected, dried over sodium sulphate, concentrated by evaporation, and dried under reduced pressure.
Yield: 69.2 g (72%) of compound (39).

Step 5

A solution of 32.5 g of compound (7) in 145 ml of pyridine is added dropwise at 50° C. to a solution of 68.2 g (0.114 mol) of compound (39) in 300 ml of pyridine. The reaction mixture is stirred for 1 h at 50° C. and then poured out in 1 l of ice-cold 5N hydrochloric acid. The mixture is stirred until solidification of the reaction product. The precipitate is filtered with suction, rinsed with water until neutral, and dried at 50° C.
Yield: 66.4 g (69%) of compound (40).

Step 6

An amount of 65 g (0.0769 mol) of compound (40) is dissolved in 1250 ml of 1-methoxy-2-propanol. A volume of 190 ml of concentrated hydrochloric acid is added with stirring to the solution. After 15 min the hydrochloric acid has disolved completely. After addition of 19 ml of water, the solution is refluxed and stirred for 3 h. The reaction mixture is poured out in 6 l of ice and water. The reaction product is filtered and dried at 50° C.
Yield: 58.8 g (95%) of compound (41).

Step 7

An amount of 58.0 g (0.0727 mol) of compound (41) is dissolved in 230 ml of acetone. An amount of 40.6 g of pyridine and 23.0 ml of water is added to the solution. An amount of 54.15 g (1 equivalent) of compound (10) is added. The reaction mixture is stirred for 1 h at 50° C. The reaction mixture is poured out slowly in ice-cold 5N hydrochloric acid. The mixture is stirred for 1 h until solidification of the reaction product, which is filtered with suction, rinsed with water until neutral, and dried at 25° C.
Yield: 94.8 g (88%) of compound (42).

Step 8

A volume of 13.56 ml (1.3 equivalent) of compound (13) is added dropwise to a solution of 9.5 g (0.00635 mol) of compound (42) in 66.5 ml of 1-methoxy-2-propanol at 0°-5° C. Stirring is continued overnight. The reaction mixture is poured out on 1.5 l of icewater and stirred until solidification of the reaction product. The precipitate is filtered with suction, rinsed with water until neutral, and dried at 25° C.
Yield: 2.6 g of IHR-compound C/UV 01.

PREPARATION 8: magenta dye-releasing IHR-compound M/UV 01

Steps 1 to 7 are identical to those described in Preparation 7 and step 8 is according to the following reaction scheme:

Step 8

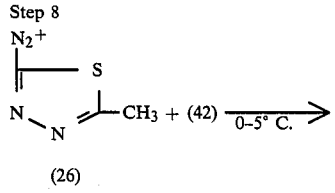

IHR—compound M/UV 01

A solution of 9.5 g (0.006349 mol) of compound (42) in 66.5 ml of methyl cellosolve acetate is cooled to 5° C. A volume of 16.2 ml (1.5 equivalent) of compound (26) is added dropwise at 0°-5° C. The reaction mixture is stirred for 90 min and poured out on 1 l of icewater. The reaction product is filtered with suction, rinsed until neutral, and dried at 25° C.
Yield: 9.9 g of IHR-compound M/UV 01.

PREPARATION 9: cyan dye-releasing IHR-compound C/UV 02

Reaction scheme:

Step 1

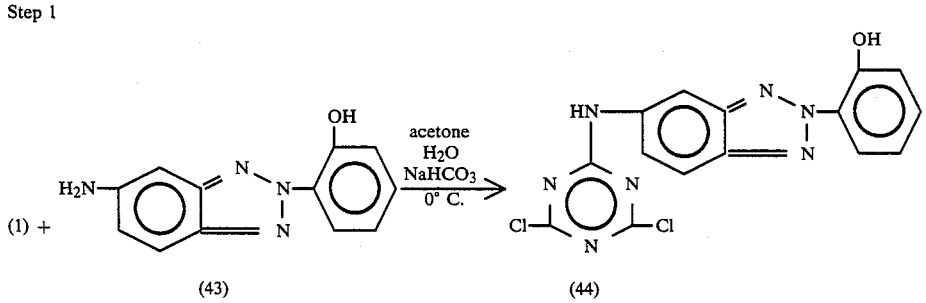

Step 2

-continued
Reaction scheme:
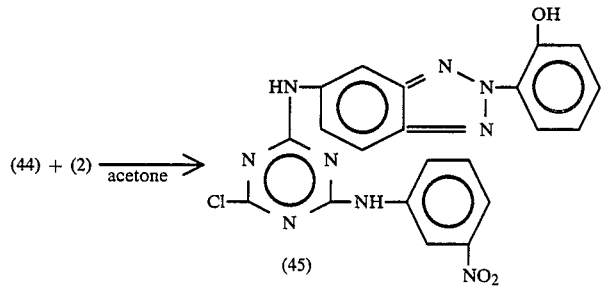
(45)
Step 3
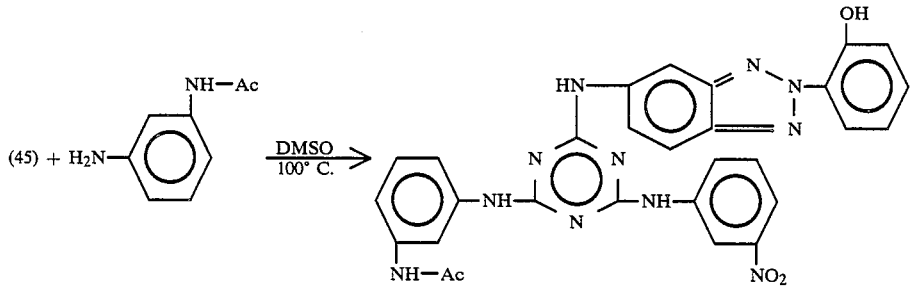
(46)
Step 4
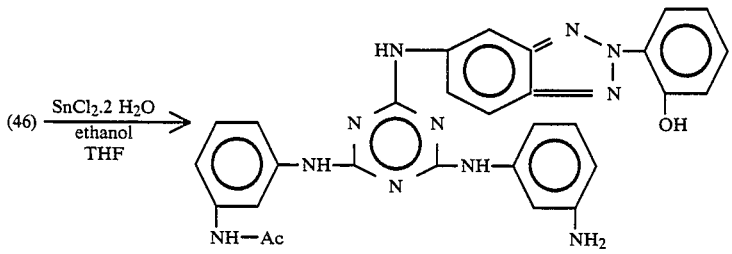
(47)
Step 5
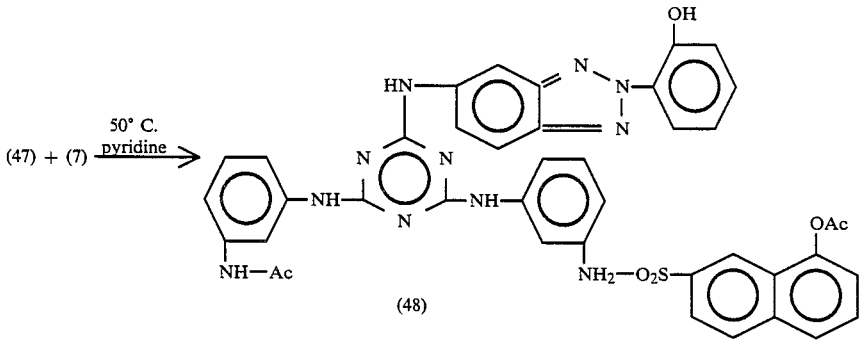
(48)
Step 6

-continued

Reaction scheme:

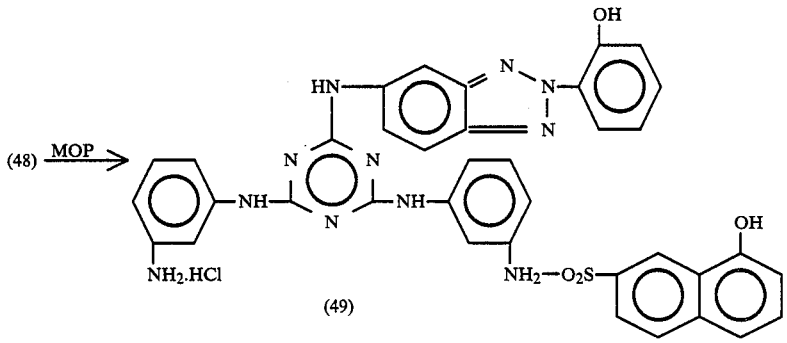

Step 7

(49) + (10) $\xrightarrow[\text{acetone}]{\text{pyridine}}$

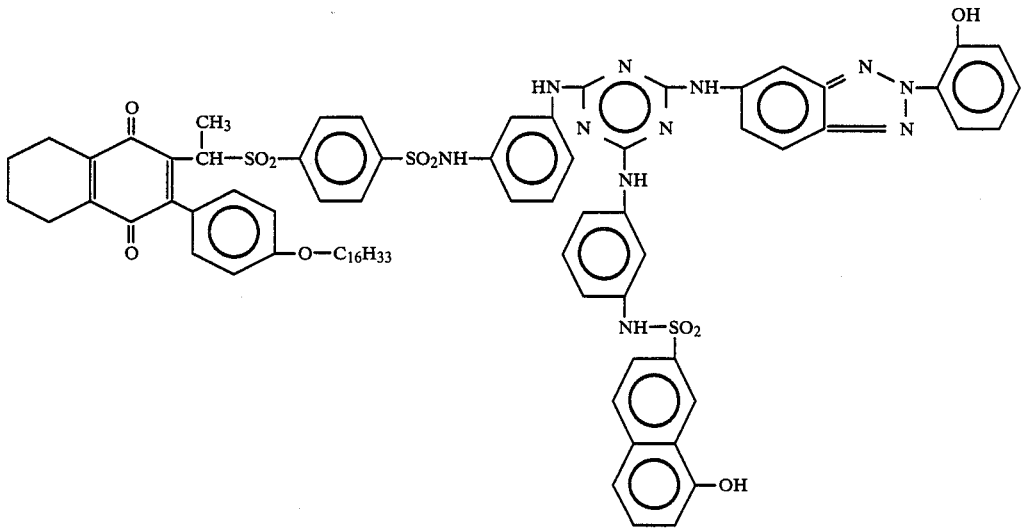

Step 8

(13) + (50) $\longrightarrow$ IHR—compound C/UV 02

Step 1

A solution of 100 g (0.54 mol) of compound (1) in 1 l of acetone is added at 0° C. to a solution of 122.5 g of compound (43) in 4 l of acetone. A volume of 1 l of a 10% aqueous solution of sodium hydrogen carbonate is added slowly whilst the temperature is kept at 0° C. The reaction product deposits immediately. The mixture is stirred for 1 h. The reaction product is filtered with suction, rinsed twice with 5 l of water, and dried at 50° C.

Yield: 199.4 g (98%) of compound (44).

Step 2

An amount of 150 g (0.40 mol) of compound (44) and 110.55 g (2 equivalents) of 3-acetamido-aniline is suspended in 3 l of acetone with vigorous stirring. The suspension is refluxed for 3 h at 50° C. The reaction mixture is cooled by means of an icebath and stirred for 2 h. The reaction product is filtered with suction, rinsed thoroughly with acetone, then with water, again with acetone, and dried at 50° C.

Yield: 87.5 g of compound (45).

Step 3

An amount of 85.0 g (0.179 mol) of compound (45) and 53.6 g (2 equivalents) of 3-acetamido-aniline is dissolved in 650 ml of dimethyl sulphoxide. The solution is stirred for 2 h at 100° C. The reaction mixture is allowed to cool and poured out with a fine jet in 8 l of of icewater and 250 ml of concentrated hydrochloric acid with vigorous stirring. The reaction product is filtered with suction, rinsed with water until neutral, and dried at 50° C.

Yield: 101.5 g (96%) of compound (46).

Step 4

A solution of 100 g (0.17 mol) of compound (46) and 128 g (6 equivalents) of $SnCl_2.2\ H_2O$ in 1000 ml of ethanol and 1000 ml of tetrahydrofuran is refluxed vigorously for 4 h and is poured out subsequently in 6 l of ethyl acetate. The reaction mixture is stirred for 30 min. The pH of the reaction mixture is adjusted to 9 by means of 7 l of saturated aqueous solution of sodium hydrogen carbonate. The reaction mixture is stirred for 30 min. An amount of 700 g of celite is added. The reaction mixture is stirred until it is homogeneous. The Sn-salts are filtered off and then rinsed first with 1 l of ethyl acetate. The organic phase is collected, rinsed twice with 2.5 l of a saturated aqueous sodium chloride solution, dried over sodium sulphate, concentrated by evaporation, and dried under reduced pressure.
Yield: 83 g (87%) of compound (47).

Step 5

A solution of 26.7 g (1.05 equivalent) of compound (7) in 75 ml of pyridine is added dropwise at 50° C. to a solution of 50 g (0.0894 mol) of compound (47) in 100 ml of pyridine. The reaction mixture is stirred for 30 min and then poured out in 250 ml of ice-cold 5N hydrochloric acid. The mixture is stirred until solidification of the reaction product. The precipitate is filtered with suction, rinsed with water until neutral, and dried.
Yield: 57.6 g (80%) of compound (48).

Step 6

An amount of 57.6 g (0.071 mol) of compound (48) is dissolved in 700 ml of 1-methoxy-2-propanol. The resulting solution is heated to 100° C. A volume of 176 ml of concentrated hydrochloric acid (15 equivalents) and 70 ml of water is added at 100° C. with stirring for 3 h. The reaction product deposits in the reaction mixture. The reaction mixture is allowed to cool to room temperature. The reaction product is filtered, rinsed with water until neutral, and dried at 50° C.
Yield: 50.7 g (93%) of compound (49).

Step 7

An amount of 50 g of compound (49) is dissolved in 150 ml of pyridine. An amount of 51.5 g (1.05 equivalent) of solid compound (10) and 10 ml of water is added to the solution. The reaction mixture is stirred for 30 min at 50° C. The reaction mixture is poured out slowly in ice-cold 5N hydrochloric acid with stirring. The mixture is stirred for another hour. The reaction product is filtered with suction, rinsed with water until neutral, and dried at 25° C.

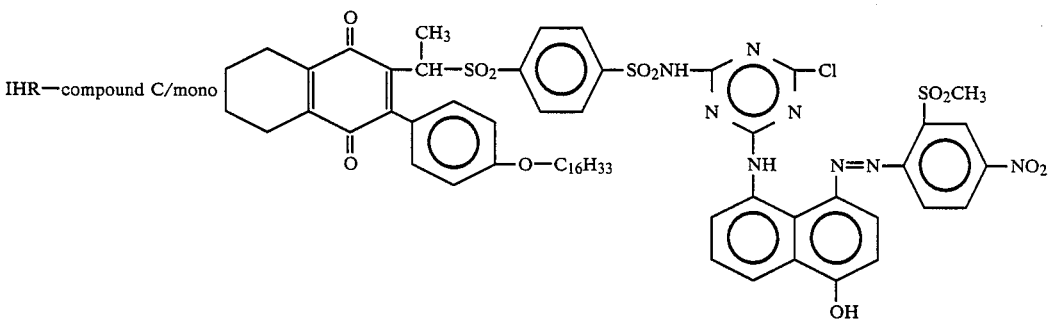

Yield: 94.4 g (100%) of compound (50).

Step 8

A volume of 24.2 ml (1.1 equivalent) of compound (13) is added dropwise slowly to a solution of 20 g (0.01397 mol) of compound (50) in 140 ml of methyl cellosolve acetate at 5° C. The reaction mixture is allowed to react overnight. The reaction mixture is poured out on 1 kg of ice and 200 ml of methanol and stirred until all ice has melted. The reaction product is filtered with suction, rinsed with water until neutral, and dried at 25° C.
Yield: 22.3 g of IHR-compound C/UV 02.

PREPARATION 10: magenta dye-releasing IHR-compound M/UV 02

Steps 1 to 7 are identical to those described in Preparation 9 and step 8 is according to the following reaction scheme:

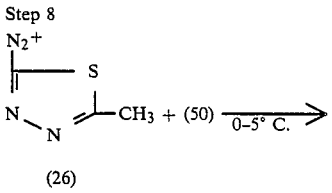

IHR—compound M/UV 02

An amount of 17 g (0.0119 mol) of compound (50) is dissolved in 119 ml of methyl cellosolve acetate is cooled to 5° C. A volume of 1.3 equivalent of compound (26) is added dropwise at 0°-5° C. The reaction mixture is stirred for 3 h and poured out on 1 kg of icewater and 200 ml of methanol with stirring until all ice has melted. The reaction product is filtered with suction, rinsed until neutral, and dried at 25° C.
Yield: 18.7 g of IHR-compound M/UV 02.

Other dye-releasing compounds for use in accordance with the present invention and corresponding to the above general formula I can be prepared analogously or by techniques known in the art starting with the appropriate chemicals.

It is interesting to mention that during the search for dye-releasing compounds that eventuated in the finding of the compounds according to the present invention, also other dye-releasing compounds were synthesized, which differed from those according to the present invention in that they comprise a s-triazine nucleus carrying only one photographically useful group. An example of such other dye-releasing compounds is the cyan mono-azo dye IHR-compound corresponding to the following structural formula:

The compounds according to the present invention are suited for use in a dye diffusion transfer process and for that purpose are used in operative association with a light-sensitive silver halide emulsion layer, preferably of the negative-working type, i.e. of the type giving a silver image in the photo-exposed areas.

For dye image production a photographic element according to the present invention comprises a support carrying at least one alkali-permeable silver halide hydrophilic colloid emulsion layer having in operative association therewith a dye-releasing compound corresponding to the above general formula I.

By "operative association" is meant that the release of a diffusible moiety, e.g. a diffusible azo dye moiety, from the compound can proceed in dependence on and as a function of the development of the silver halide emulsion layer. The dye-releasing compound need not be present in the silver halide emulsion layer itself but may be contained in another layer that is in water-permeable relationship therewith.

According to an embodiment for the production of multicolour images the present invention provides a photographic element that comprises a support carrying (1) a red-sensitive silver halide emulsion layer having operatively associated therewith a dye-releasing compound that initially is immobile in an alkali-permeable colloid medium and from which, inversely proportional to the development of the image-wise exposed silver halide by a silver halide developing agent in alkaline conditions and a redox reaction, a cyan dye is split off in diffusible state, (2) a green-sensitive silver halide emulsion layer having operatively associated therewith another dye-releasing compound with the difference that a magenta dye is split off in diffusible state, and (3) a blue-sensitive silver halide emulsion layer having operatively associated therewith a further dye-releasing compound with the difference that a yellow dye is split off in diffusible state, at least one of said dye-releasing compounds being one of the compounds according to the present invention as defined above.

In the compounds for use according to the present invention the dye group(s) may be associated with substituents that form a shifted dye.

Shifted dyes as described in e.g. U.S. Pat. No. 3,260,597 include compounds, whose light-absorption range is shifted hypsochromically or bathochromically when subjected to a different environment such as a change of the $pK_a$-value of the compound.

It is preferred to carry out the colour diffusion transfer process with the present coloured dye-releasing compounds in conjunction with a mixture of reducing agents, at least two of which being a compound called electron-donor (ED-compound) and a compound called electron-transfer agent (ETA-compound) respectively.

The ED-compounds are preferably non-diffusing, e.g. they are provided with a ballasting group, so that they remain within the layer unit wherein they have to transfer their electrons to the dye-releasing compound.

The ED-compound is preferably present in non-diffusible state in each silver halide emulsion layer containing a different non-diffusible coloured dye-releasing compound. Examples of such ED-compounds are ascorbyl palmitate and 2,5-bis(1',1',3',3'-tetramethylbutyl)-hydroquinone. Other ED-compounds have been disclosed in U.S. Pat. No. 4,139,379 and in German Pat. No. 2,947,425. Instead of an ED-compound an electron-donor precursor (EDP) compound can be used in the photographic element as described e.g. in German Pat. No. 2,809,716 and in U.S. Pat. No. 4,278,750. Particularly useful EDP-compounds for combination with the present dye-releasing compounds have been disclosed in European Pat. No. 0,124,915 and in German Pat. No. 3,006,268, wherein the compound corresponds to the following general formula:

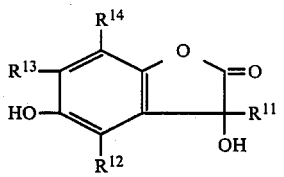

wherein:

$R^{11}$ represents a carbocyclic or heterocyclic aromatic ring, each of $R^{12}$, $R^{13}$ and $R^{14}$ (same or different) represents hydrogen, alkyl, alkenyl, aryl, alkoxy, alkylthio, amino, or $R^{13}$ and $R^{14}$ together represent an adjacent ring, e.g. carbocyclic ring, at least one of $R^{11}$, $R^{12}$, $R^{13}$ and $R^{14}$ representing a ballast group having from 10 to 22 carbon atoms.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

Typically useful ETA-compounds include hydroquinone compounds, aminophenol compounds, catechol compounds, phenylenediamines and 3-pyrazolidinone compounds e.g. 1-aryl-3-pyrazolidinone as described in e.g. U.S. Pat. No. 4,139,379.

A combination of different ETA-compounds such as those disclosed in U.S. Pat. No. 3,039,869 can be employed likewise. Such developing agents can be used in the liquid processing composition or can be contained, at least partially, in any layer or layers of the photographic element or film unit such as the silver halide emulsion layers, the dye image-providing material layers, interlayers, image-receiving layer, etc. The particular ETA-compound selected will, of course, depend on the particular electron-donor and dye-releasing compound used in the process and the processing conditions for the particular photographic element.

The concentration of ED-compound or EDP-compound in the photographic element may vary within a broad range but is, e.g., in the molar range of 1:1 to 8:1 with respect to the dye-releasing compound. The ETA-compound can be present in the alkaline aqueous liquid used in the development step, but is used preferably in diffusible form in a non-sensitive hydrophilic colloid layer adjacent to at least one silver halide emulsion layer.

Migration of non-oxidized developing agent, e.g. acting as ETA-compound, proceeds non-image-wise and has an adverse effect on correct colour rendition when surplus developing agent remains unoxidized in the photoexposed areas of a negative-working emulsion layer. Therefore, according to a preferred embodiment of the present invention a silver halide solvent, e.g. thiosulphate, is used to mobilize unexposed silver halide in complexed form for helping to neutralize (i.e. oxidize by physical development) migrated developing agent in the photoexposed areas wherein unaffected developing agent (ETA-compound) should no longer be available for reacting with the dye-releasing compound directly or through the ED-compound used. The use of silver halide solvents for that purpose has been described in European Pat. No. 0,049,002.

For an improved colour rendition it is also advantageous to intercept oxidized ETA-compound and to prevent it from migrating to adjacent imaging layers where it could cause the undesired oxidation of ED-compound. For said interception so-called scavengers are used that are incorporated in non-diffusible state into the photographic element, e.g. in interlayers between the imaging layers. Suitable scavengers for that purpose are described in e.g. U.S. Pat. No. 4,205,987 and European Pat. No. 0,029,546.

The present dye-releasing compounds and optionally ED or EDP-compounds can be incorporated into the photographic element by addition to the coating liquid(s) of its layer(s) according to the usual methods known e.g. for the incorporation of colour couplers into photographic silver halide emulsion elements.

The amount of dye-releasing compound coated per m2 can vary within wide limits and depends on the maximum colour density desired.

The photographic element may contain (a) filter layer(s) to improve the correct spectral exposure of the differently spectrally sensitive silver halide emulsion layers e.g. a yellow (colloidal silver) layer under the only blue-sensitive silver halide emulsion layer and a magenta filter layer under the green-sensitive silver halide emulsion layer absorbing green light, to which the underlying red-sensitized silver halide emulsion layer can be sensitive to some extent. A suitable magenta dye for that purpose is Violet Quindo RV 6911 - Colour Index, C.I 46500 Pigment Violet 19.

The support for the photographic elements of the present invention can be any material as long as it does not deleteriously affect the photographic properties of the film unit and is dimensionally stable. Typical flexible sheet materials are paper supports, e.g. coated on one or on both sides with an Alpha-olefin polymer, e.g. polyethylene; they include cellulose nitrate film, cellulose acetate film, polyvinyl acetal film, polystyrene film, poly(ethylene terephthalate) film, polycarbonate film, poly-Alpha-olefins such as polyethylene and polypropylene film, and related films or resinous materials. The support usually has a thickness of approximately 0.05 to 0.15 mm.

The image-receiving layer can form part of a separate image-receiving element or form an integral combination with the light-sensitive layer(s) of the photographic element.

When after the processing of the photographic element the image-receiving layer is to remain associated with the silver halide emulsion layer(s) of the photographic element, an alkali-permeable light-shielding layer, e.g. a layer containing white pigment particles can be applied between the image-receiving layer and the silver halide emulsion layer(s).

Any material can be employed as image-receiving layer in dye diffusion transfer photgraphy, provided it performs the desired function of mordanting or otherwise fixing the diffused dye(s). The selection of the particular material to be used is, of course, determined by the dye to be mordanted. If acid dyes are to be mordanted, the image-receiving layer may be composed of or contain basic polymeric mordants such as polymers of amino-guanidine derivatives of vinyl methyl ketone as described in U.S. Pat. No. 2,882,156 of Louis M. Minsk, issued Apr. 14, 1959, and basic polymeric mordants and derivatives, e.g. poly-4-vinylpyridine, the metho-p-toluene sulphonate of 2-vinylpyridine and similar compounds described in U.S. Pat. No. 2,484,430 of Robert H. Sprague and Leslie G. Brooker, issued Oct. 11, 1949, and the compounds described in German Pat. No. 2,200,063 filed Jan. 11, 1971 by Agfa-Gevaert A. G. Suitable mordanting binders include e.g. guanylhydrazone derivatives of acyl styrene polymers as described in e.g. German Pat. No. 2,009,498 filed Feb. 28, 1970 by Agfa-Gevaert A. G. In general, however, other binders e.g. gelatin, are added to the latter mordanting binders. Effective mordanting compositions are long-chain quaternary ammonium or phosphonium compounds or ternary sulphonium compounds, e.g. those described in U.S. Pat. No. 3,271,147 of Walter M. Bush and U.S. Pat. No. 3,271,148 of Keith E. Whitmore, both issued Sept. 6, 1966, and n-hexadecyl-trimethyl-ammonium bromide. Certain metal salts and their hydroxides that form sparingly soluble compounds with the acid dyes can be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which preferably is permeable to alkaline solution, is transparent and has a thickness of approximately 4 to approximately 10 μm. This layer thickness can, of course, be modified depending upon the result desired. The image-receiving layer may also contain i.a. ultraviolet-absorbing substances to protect the mordanted dye images from fading, brightening agents such as stilbenes, coumarins, triazines, oxazoles, and dye stabilizers such as the chromanols, alkyl-phenols.

The use of pH-lowering substances in the dye-image-receiving element usually increases the stability of the transferred image. Generally, the pH-lowering substances cause a reduction of the pH of the image layer from about 13 or 14 to 11 and preferably even to 7–5 within a short time after imbibition. For instance, polymeric acids as disclosed in U.S. Pat. No. 3,362,819 of Edwin H. Land, issued Jan. 9, 1968, or solid acids or metal salts, e.g. zinc acetate, zinc sulphate, magnesium acetate as disclosed in U.S. Pat. No. 2,584,030 of Edwin H. Land, issued Jan. 29, 1952 can be employed with good results. Such pH-lowering substances reduce the pH of the film unit after development to terminate development and substantially reduce further dye transfer and thus stabilize the dye image.

An inert timing or spacer layer can be employed over the pH-lowering layer. Such layer "times" or controls the pH-reduction depending upon the rate, at which alkali diffuses through the inert spacer layer. Examples of such timing layers include gelatin, polyvinyl alcohol, and any of the colloids disclosed in U.S. Pat. No. 3,455,686 of Leonard C. Farney, Howard G. Rogers and Richard W. Young, issued July 15, 1969. The timing layer can be effective in evening out the various reaction rates over a wide range of temperatures. For instance, premature pH-reduction is prevented when imbibition is effected at temperatures above room temperature e.g. at 35°–37° C. The timing layer usually has a thickness of approximately 2.5 μm to approximately 18 μm. Especially good results are obtained if the timing layer comprises a hydrolysable polymer or a mixture of such polymers that are slowly hydrolysed by the processing composition. Examples of such hydrolysable polymers include polyvinyl acetate, polyamides, cellulose esters, etc.

An alkaline processing composition used in the production of dye images according to the present invention can be a conventional aqueous solution of an alkaline material, e.g. sodium hydroxide, sodium carbonate or an amine such as diethylamine, preferably having a pH beyond 11.

According to one embodiment the alkaline processing liquid contains the diffusible developing agent that effects the reduction of the silver halide, e.g. ascorbic acid or a 3-pyrazolidinone developing agent such as 1-phenyl-4-methyl-3-pyrazolidinone.

The alkaline processing composition used according to the present invention may also contain a desensitizing agent such as i.a. methylene blue, nitro-substituted heterocyclic compounds, 4,4'-bipyridinium salts, to ensure that the photographic element is not further exposed after its removal from the camera for processing.

For in-camera-processing, the solution also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of approximately 1 to approximately 5% by weight of the processing composition is preferred. It imparts a viscosity of approximately 100 mPa.s to approximately 200,000 mPa.s. to the processing composition.

Although the common purpose in the known dye-diffusion transfer systems is to produce dye images in a receiving layer or sheet, the released dye(s) leaving the photosensitive element by diffusion transfer, a residual image of dye can also be of practical interest for the formation of a so-called "retained image". The latter terminology has been used in e.g. Research Disclosure (No. 17362) of Sept. 1978. A dye diffusion process relating thereto has been exemplified in Research Disclosure (No. 22711) of Mar. 1983.

Processing may proceed in a tray developing unit as provided usually in an ordinary silver complex diffusion transfer apparatus, in which contact between the image-wise exposed photographic element and a separate dye image-receiving element is effected after sufficient absorption of processing liquid by these elements has taken place. A suitable apparatus for said purpose is the COPYPROOF CP 38 (trade name) DTR-developing apparatus. COPYPROOF is a trade name of Agfa-Gevaert, Antwerp/Leverkusen.

In the case that the light-sensitive layer(s) and the image-receiving layer are integrated in one single element, the processing liquid can be applied from at least one rupturable container, which may itself form part of said element, or it can be applied by spraying.

Examples of rupturable containers that can be used are those disclosed in U.S. Pat. No. 2,543,181 of Edwin H. Land, issued Feb. 27, 1951, U.S. Pat. No. 2,643,886 of Ulrich L. di Ghilini, issued June 30, 1953, U.S. Pat. No. 2,653,732 of Edwin H. Land, issued Sept. 29, 1953, U.S. Pat. No. 2,723,051 of William J. McCune Jr., issued Nov. 8, 1955, U.S. Pat. No. 3,056,492 and U.S. Pat. No. 3,056,491, both of John E. Campbell, issued Oct. 2, 1962, and U.S. Pat. No. 3,152,515 of Edwin H. Land, issued Oct. 13, 1964. In general, such containers comprise a rectangular sheet of fluid- and air-impervious material folded longitudinally upon itself to form two walls that are sealed to one another along their longitudinal and end margins to form a cavity in which processing liquid is contained.

In the above described dye diffusion transfer processing the development temperature is normally room temperature, i.e. approximately 20° C., but according to a particular embodiment the dye-releasing compounds according to the present invention are used in a so-called photothermographic dye diffusion transfer method, e.g. of the type described in European Pat. No. 0,120,306 and German Pat. No. 3,215,485.

In said embodiment the image formation comprises image-wise exposing a light-sensitive element and heating it in the presence of a small amount of water, the element comprising a support having provided thereon light-sensitive silver halide in a binder, a reducing agent capable of reducing the light-sensitive silver halide, and at least one of the dye-releasing compounds according to the present invention.

In an embodiment of said method a photographic element is used, which contains a combination of silver halide and silver benzotriazolate, a developing agent, a said dye-releasing compound, and a base precursor releasing a base upon heating as described e.g. in Great Britian Pat. No. 998,949. The image-wise exposed photographic element is moistened with water as the sole processing liquid, brought in contact with an image-receiving element, and the resulting sandwich is subjected to heat, so that development of the exposed silver halide and transfer of image-wise released dye can take place.

According to a particular embodiment the heat-induced development of the exposed silver halide proceeds in the presence of a thermal solvent.

Examples of thermal solvents and the use thereof are given in the Research Disclosure publications, Oct. 1976, item 15027, Nov. 1976, item 15108, and June 1978, item 17029; in German Pat. No. 3,529,930 and German Pat. No. 3,529,934, and in European Pat. No. 119,615 and European Pat. No. 112,512.

Thermal solvents are solid at room temperature (20° C.) but play the role of a good solvent for water-soluble compounds in molten form by their relatively strong dipole moment.

The following example further illustrates the present invention.

EXAMPLE

Preparation of a receptor element

The following composition was applied to a corona-treated polyethylene-coated paper support:

| | | |
|---|---|---|
| (1) | gelatin | 2.5 g |
| | polymeric mordanting agent, prepared from 4,4'-diphenylmethane diisocyanate and N—ethyldiethanolamine quaternized with epichlorohydrin as described in Example 1 of US-A 4,186,014 | 2.5 g |
| (2) | protective gelatin layer | 0.8 g |

Preparation of photographic elements

Identical strips of subbed polyethylene terephthalate support having a thickness of 0.1 mm were coated with the following layers in the order given:

(1) a silver halide emulsion layer containing:
- gelatin, in the amount given in Table 8 hereinafter
- AgCl, expressed as $AgNO_3$, in the amount given in Table 8 hereinafter
- IHR-compound of Table 8, in the amount indicated therein
- ED compound 2,5-bis(1',1',3',3'-tetramethylbutyl)-hydroquinone, in the amount given in Table 8 hereinafter, (2) protective layer containing:
- gelatin, in the amount given in Table 9 hereinafter 1-phenyl-4-methyl-pyrazolidin-3-one, in the amount given in Table 9 hereinafter citric acid, in the amount given in Table 9 hereinafter, to lower the pH.

Each of the resulting strips contained a different IHR-compound, as indicated in Table 8.

TABLE 8

| | Coated strips A to H containing the following ingredients in the silver halide emulsion layer: | | | | | | |
|---|---|---|---|---|---|---|---|
| | IHR-compound | | | $AgNO_3$ | ED compound | | gelatin |
| Strip: | N° | g/m2 | mmol/m2 | g/m2 | g/m2 | mmol/m2 | g/m2 |
| A | C/mono | 0.380 | 0.328 | 0.610 | 0.260 | 0.487 | 2.0 |
| B | C 01 | 0.233 | 0.118 | 0.580 | 0.095 | 0.178 | 1.8 |
| C | C/SOS 01 | 0.361 | 0.238 | 0.580 | 0.188 | 0.352 | 1.8 |
| D | C/SOS 02 | 0.573 | 0.353 | 0.570 | 0.287 | 0.538 | 2.9 |
| E | C/UV 01 | 0.465 | 0.306 | 0.600 | 0.220 | 0.411 | 1.8 |
| F | M/SOS 01 | 0.313 | 0.220 | 0.580 | 0.173 | 0.325 | 1.8 |
| G | M/SOS 02 | 0.460 | 0.300 | 0.600 | 0.240 | 0.450 | 1.8 |
| H | M/UV 01 | 0.455 | 0.285 | 0.600 | 0.220 | 0.411 | 2.0 |

TABLE 9

| | Coated strips A to H containing the following ingredients in the protective layer: | | |
|---|---|---|---|
| Strip: | gelatin g/m2 | 1-phenyl-4-methyl-pyrazolidin-3-one | citric acid |
| A | 2.4 | 0.25 g | 0.06 g |
| B | 2.5 | 0.25 g | 0.06 g |
| C | 2.5 | 0.25 g | 0.06 g |
| D | 3.1 | 0.25 g | 0.06 g |
| E | 3.0 | 0.25 g | 0.06 g |
| F | 2.5 | 0.25 g | 0.06 g |
| G | 2.5 | 0.25 g | 0.06 g |
| H | 3.0 | 0.25 g | 0.06 g |

All coated strips were exposed image-wise and together with a receptor element as described above fed through a COPYPROOF (registered trade name of Agfa-Gevaert N. V. Belgium) CP 42 diffusion transfer processing apparatus containing in its tray an aqueous alkaline processing liquid comprising per liter:

| | |
|---|---|
| sodium hydroxide | 25 g |
| sodium orthophosphate | 25 g |
| cyclohexane dimethanol | 80 g |
| potassium iodide | 2 g |
| sodium thiosulphate | 2 g |
| 2,2-methylpropylpropane diol | 25 g |
| N—ethylbenzene-pyridinium chloride | 0.5 g |
| distilled water to make | 1000 ml |

After having been moistened at room temperature (20° C.) with said solution each of the exposed strips was placed in contact for 5 min with a receptor element as described above, to allow the diffusion transfer of the dyes to take place. After separation of the strips of photographic element from the receptor elements the visual light spectral density obtained by the dye transfer was measured with a MACBETH (trade name) densitometer RD-919 in the Status A modus. The values obtained for minimum density (D min) and for maximum density (D max) are listed in Table 10. In Table 10 the transferred dye images are indicated with the same letters A to H corresponding to those of the strips of photographic element, by means of which the dye images were made.

The absorption maximum (Abs. max) of the dyes transferred to the receptor elements by diffusion and mordanted therein was measured, the values obtained being listed also in Table 10.

TABLE 10

| Dye image: | D min | D-max | Abs. max |
|---|---|---|---|
| A | 0.15 | 0.88 | 650 |
| B | 0.13 | 1.85 | 638 |
| C | 0.13 | 2.14 | 642 |
| D | 0.13 | 1.44 | 641 |
| E | 0.11 | 2.00 | 638 |
| F | 0.13 | 1.39 | 558 |
| G | 0.15 | 1.25 | 556 |
| H | 0.15 | 1.88 | 554 |

From the results given for maximum density it can be concluded—especially when IHR-compound C 01 (Strip B) according to the present invention comprising two cyan dye groups as PUG is compared with IHR-compound C/mono (Strip A), which is outside the scope of the present invention since it comprises but one cyan dye group (1 PUG identical to each of those of IHR-compound C 01)—that the maximum density obtained with the compounds of the present invention is considerably higher than that obtained with the compound comprising but one dye group. This is the more striking when the molar ratios of IHR-compound C 01 and IHR-compound C/mono in Table 8 are compared (0.118 and 0.328 mmol/m2 respectively).

We claim:

1. Photographic silver halide emulsion element for dye image production comprising a support carrying at least one alkali-permeable silver halide hydrophilic colloid emulsion layer incorporating in operative association therewith a dye-releasing compound capable of releasing a diffusible dye moiety from a carrier moiety by a redox reaction, wherein said dye-releasing compound corresponds to the following general formula I:

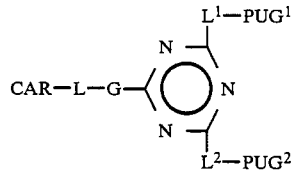

(I)

wherein:

CAR represents an organic carrier moiety capable of undergoing a redox reaction, which moiety may contain a ballasting group rendering said compound non-diffusing in a hydrophilic colloid medium in wet alkaline conditions, L represents a chemical group cleavable or releasable from the carrier moiety by a redox reaction taking place in alkaline conditions in dependence on and as a function of the development of a silver halide emulsion layer incorporating such compound, G represents a bridging group, each of $L^1$ and $L^2$ (same or different) represents a chemical bond, a polyvalent atom, a polyvalent atom group, or a hydrocarbon group, $PUG^1$ represents a photographically useful group selected from the group consisting of a dye group and a dye precursor group, and $PUG^2$ represents a photographically useful group selected from the group consisting of a dye group, a dye precursor group, an UV-absorber group, and a singlet oxygen scavenger group, and wherein, when $PUG^2$ is a dye group or a dye precursor group, it may have the same or a different composition as $PUG^1$.

2. A photographic element according to claim 1, wherein said dye-releasing compound is one wherein G is a bridging group $—(Ar^1—SO_2NR^1)_n—Ar^2—X—$, wherein $R^1$ represents hydrogen or alkyl, each of $Ar^1$ and $Ar^2$ (same or different) represents a bivalent aromatic nucleus or such nucleus carrying one or more substituents, X is a polyvalent atom or a polyvalent atom group, and n is a positive integer.

3. A photographic element according to claim 1, wherein said dye-releasing compound corresponds to the following general formula (II):

(II)

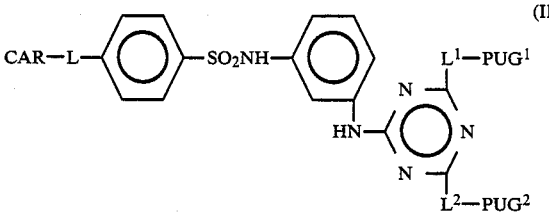

wherein:

CAR represents an organic carrier moiety capable of undergoing a redox reaction, which moiety may contain a ballasting group rendering said compound non-diffusing in a hydrophilic colloid medium in wet alkaline conditions, L represents a chemical group cleavable or releasable from the carrier moiety by a redox reaction taking place in alkaline conditions in dependence on and as a function of the development of a silver halide emulsion layer incorporating such compound, each of $L^1$ and $L^2$ (same or different) represents a chemical bond, a polyvalent atom, a polyvalent atom group, or a hydrocarbon group, $PUG^1$ represents a photographically useful group selected from the group consisting of a dye group and a dye precursor group, and $PUG^2$ represents a photographically useful group selected from the group consisting of a dye group, a dye precursor group, an UV-absorber group, and a singlet oxygen scavenger group, and wherein, when $PUG^2$ is a dye group or a dye precursor group, it may have the same or a different composition as $PUG^1$.

4. A photographic element according to claim 3, wherein said dye-releasing compound is one wherein —L— is $—SO_2$ and each of $L^1$ and $L^2$ stands for a bivalent group corresponding to the structural formula:

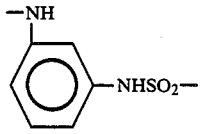

5. A photographic element according to claim 1, wherein said dye-releasing compound is a quinonoid IHR-compound.

6. A photographic element according to claim 1, wherein said dye-releasing compound is one wherein the group CAR corresponds to one of the following structural formulae CAR 1 and CAR 2:

CAR 1

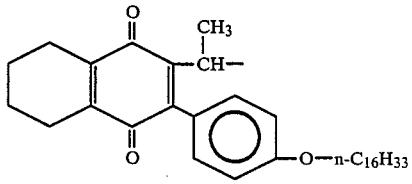

CAR 2

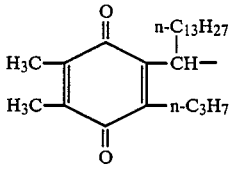

7. A photographic element according to claim 1, wherein said dye-releasing compound is one wherein the photographically useful groups correspond to any of the following structural formulae:

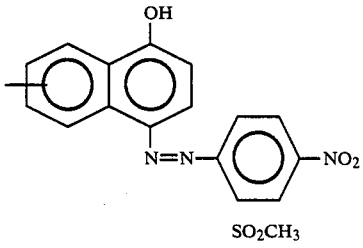

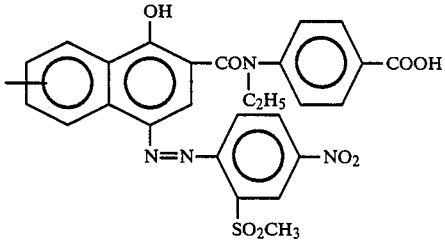

-continued

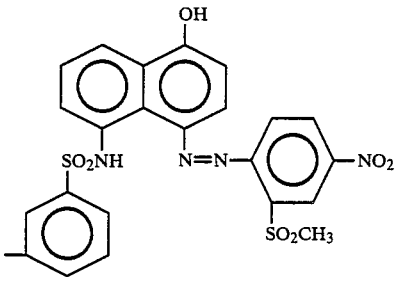

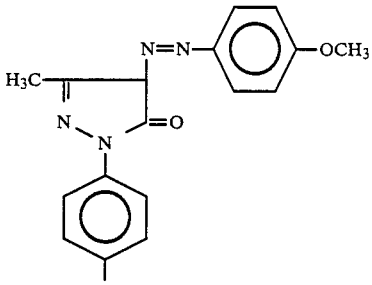

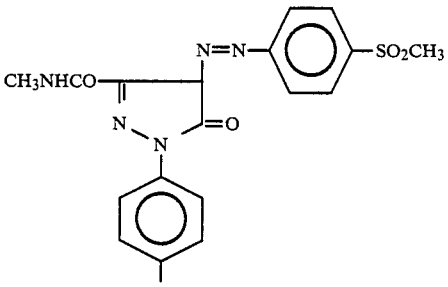

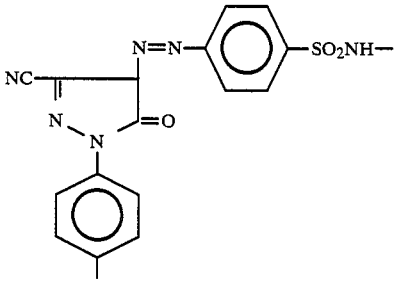

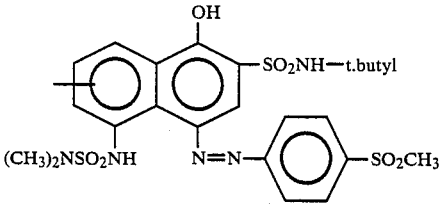

-continued

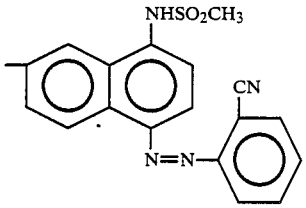

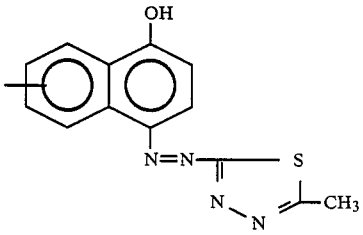

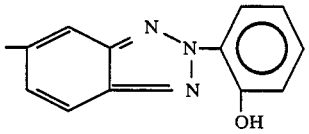

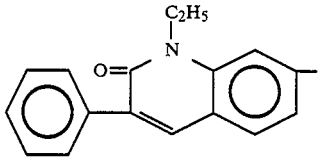

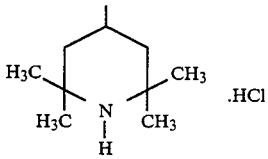

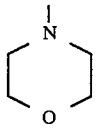

8. A photographic element according to claim 1, wherein said support carries red-, green- and blue-sensitive silver halide emulsion layers, at least one of which has operatively associated therewith a said dye-releasing compound.

9. A photographic element according to claim 1, wherein said photographic element contains in each silver halide emulsion layer a non-diffusing electron-donor compound or electron-donor precursor compound.

10. A photographic element according to claim 1, wherein said photographic element contains (a) silver halide emulsion layer(s) of the negative-working type.

* * * * *